US008820388B2

(12) United States Patent
Mullet et al.

(10) Patent No.: US 8,820,388 B2
(45) Date of Patent: Sep. 2, 2014

(54) MOTORIZABLE SHADE SYSTEM AND METHOD

(75) Inventors: Willis Jay Mullet, Gulf Breeze, FL (US); Benjamin Bruckner, Atlanta, GA (US); Darrin W. Brunk, Pensacola, FL (US); Richard Scott Hand, Pace, FL (US)

(73) Assignee: Qmotion Incorporated, Pensacola, FL (US)

( * ) Notice: Subject to any disclaimer, the term of this patent is extended or adjusted under 35 U.S.C. 154(b) by 325 days.

(21) Appl. No.: 12/925,269

(22) Filed: Oct. 18, 2010

(65) Prior Publication Data

US 2012/0090797 A1 Apr. 19, 2012

(51) Int. Cl.
*E06B 9/74* (2006.01)
*E06B 9/322* (2006.01)

(52) U.S. Cl.
CPC ..... *E06B 9/322* (2013.01)
USPC ..... 160/310; 160/331

(58) Field of Classification Search
USPC ..... 160/331, 84.04, 84.05, 171, 170, 160/168.1 R, 173 R, 178.1 R, 296, 310
See application file for complete search history.

(56) References Cited

U.S. PATENT DOCUMENTS 4,096,903 A 6/1978 Ringle, III
4,554,762 A 11/1985 Anderson
4,618,804 A 10/1986 Iwasaki
4,706,726 A 11/1987 Nortoft
5,038,087 A * 8/1991 Archer et al. ..... 318/469
5,391,967 A * 2/1995 Domel et al. ..... 318/400.08
5,413,161 A 5/1995 Corazini
5,444,339 A * 8/1995 Domel et al. ..... 318/17
5,495,153 A * 2/1996 Domel et al. ..... 318/17
5,517,094 A * 5/1996 Domel et al. ..... 318/400.08
5,531,257 A 7/1996 Kuhar
5,698,958 A * 12/1997 Domel et al. ..... 318/480
5,714,855 A * 2/1998 Domel et al. ..... 318/280
5,729,103 A * 3/1998 Domel et al. ..... 318/283
5,760,558 A * 6/1998 Popat ..... 318/480
5,793,174 A * 8/1998 Kovach et al. ..... 318/468
5,883,480 A * 3/1999 Domel et al. ..... 318/282
5,907,227 A * 5/1999 Domel et al. ..... 318/480
5,990,646 A * 11/1999 Kovach et al. ..... 318/468
6,003,584 A * 12/1999 Weinreich ..... 160/191
6,060,852 A * 5/2000 Domel et al. ..... 318/480
6,062,290 A * 5/2000 Domel ..... 160/176.1 V
6,116,320 A * 9/2000 Peterson ..... 160/84.02
6,259,218 B1 * 7/2001 Kovach et al. ..... 318/16

(Continued)

*Primary Examiner* — Katherine Mitchell
*Assistant Examiner* — Johnnie A Shablack
(74) *Attorney, Agent, or Firm* — Zarley Law Firm, P.L.C.

(57) ABSTRACT

A motorizable shade system and method consists of a header system where the header system includes an integral header attachment connection. At least one cord spool is provided within the header system and is connected with at least one suspension cord and a shade is suspended from the at least one suspension cord. A motor assembly attachment connection is provided in a motor assembly that is conformed to connect with the integral header attachment connection and the motor assembly also includes a motor assembly electrical connector. A power system with a power attachment connection is provided that is conformed to connect with the integral header attachment connection. The power system also includes a power system electrical connector that is conformed to connect with the motor assembly electrical connector. The motorizable shade system operates manually unless and until a motor assembly and power system are connected with the integral header attachment connection and the cord spool.

17 Claims, 18 Drawing Sheets

(56) References Cited

U.S. PATENT DOCUMENTS

| | | | | |
|---|---|---|---|---|
| 6,338,377 | B1 * | 1/2002 | Domel | 160/84.02 |
| 6,369,530 | B2 * | 4/2002 | Kovach et al. | 318/16 |
| 6,371,192 | B1 * | 4/2002 | Anderson et al. | 160/178.1 R |
| 6,382,294 | B1 * | 5/2002 | Anderson et al. | 160/168.1 P |
| 6,433,498 | B1 * | 8/2002 | Domel et al. | 318/280 |
| 6,446,693 | B1 | 9/2002 | Anderson et al. | |
| 6,516,858 | B1 * | 2/2003 | Anderson et al. | 160/168.1 P |
| 6,533,018 | B2 * | 3/2003 | Anderson et al. | 160/178.1 R |
| 6,536,503 | B1 | 3/2003 | Anderson et al. | |
| 6,655,441 | B2 | 12/2003 | Wen et al. | |
| 6,708,750 | B2 * | 3/2004 | Collett et al. | 160/84.02 |
| 6,736,186 | B2 * | 5/2004 | Anderson et al. | 160/168.1 P |
| 6,795,226 | B2 | 9/2004 | Agrawal et al. | |
| 6,850,017 | B1 * | 2/2005 | Domel et al. | 318/400.29 |
| 6,867,565 | B2 | 3/2005 | Maistre et al. | |
| 6,957,683 | B2 | 10/2005 | Toti | |
| 7,129,657 | B2 * | 10/2006 | Cavarec et al. | 318/280 |
| 7,147,029 | B2 * | 12/2006 | Kovach et al. | 160/121.1 |
| 7,389,806 | B2 | 6/2008 | Kates | |
| 7,857,030 | B2 * | 12/2010 | Cheng | 160/168.1 P |
| 2002/0027184 | A1 * | 3/2002 | Kovach et al. | 248/262 |
| 2002/0088561 | A1 * | 7/2002 | Anderson et al. | 160/168.1 R |
| 2003/0145956 | A1 * | 8/2003 | Domel et al. | 160/168.1 R |
| 2003/0145957 | A1 * | 8/2003 | Domel et al. | 160/168.1 R |
| 2003/0145958 | A1 * | 8/2003 | Domel et al. | 160/168.1 R |
| 2008/0230189 | A1 * | 9/2008 | Rossato et al. | 160/115 |
| 2010/0269988 | A1 * | 10/2010 | Mullet et al. | 160/310 |
| 2012/0031567 | A1 * | 2/2012 | Shier et al. | 160/1 |
| 2012/0031571 | A1 * | 2/2012 | Mullet et al. | 160/310 |
| 2012/0090797 | A1 * | 4/2012 | Mullet et al. | 160/331 |
| 2012/0111509 | A1 * | 5/2012 | Mullet et al. | 160/331 |

* cited by examiner

MOTORIZABLE SHADE SYSTEM AND METHOD

FIELD OF THE INVENTION

This invention relates to a motorizable shade system and method. In particular, in accordance with one embodiment, the invention relates to a motorizable shade system consisting of a header system where the header system includes an integral header attachment connection. At least one cord spool is provided within the header system and is connected with at least one suspension cord and a shade is suspended from the at least one suspension cord. A motor assembly attachment connection is provided in a motor assembly that is conformed to connect with the integral header attachment connection and the motor assembly also includes a motor assembly electrical connector. A power system with a power attachment connection is provided that is conformed to connect with the integral header attachment connection. The power system also includes a power system electrical connector that is conformed to connect with the motor assembly electrical connector. The motorizable shade system operates manually unless and until a motor assembly and power system are connected with the integral header attachment connection and the cord spool.

BACKGROUND OF THE INVENTION

A problem exists in the field of shade devices. "Shade devices" includes all forms of devices used to provide covering or shade such as window shades for example only. While the art is replete with manual shades, meaning shades that must be operated by hand, and mechanical shades, meaning shades that are operated by machines such as motors, there are no shades that are manual that are conformed to be converted to mechanical if and when the user desires. This is to say, certainly a person can convert a manual shade to a mechanical shade by adding a motor and wiring the operable parts and power connections, etc. together, but this is a task way beyond the skill set of the ordinary user. Further, the resulting device can never look the same as a result of the addition of these elements most of which will of necessity be located on the outside, visible, exterior of the old manual shade.

There are several reasons why a person may wish to convert a manual shade to a mechanical shade. One reason is, of course, ease of operation. Another reason may be that the user is concerned about the potential hazard represented by the presence of the manual "operational cord". The "operational cord" is the cord the user manipulates to cause the shade to lower or raise or tilt. Operational cords often are found in a continuous loop and the loop has been indicated in several serious accidents involving children and pets getting entangled with the loop.

There have been several solutions to eliminating the manual operational cords from blinds and shades because of the fact that operational cords pose a danger to children and pets and are simply not aesthetically pleasing. Applicants are aware, for example, that there are add-on battery powered actuators that operate the manual operating cords to raise and lower the shade but they do not eliminate the ugly cords or the danger posed by the cords. Further, these add on systems require installation of connecting wires, screws and bolts, which take up limited space and are difficult to conceal and pose potential interference problems with existing cords and strings and other internal moving parts.

Applicants are also aware that shade systems exist that are counterbalanced such that the shade can be moved to a desired position by pulling or pushing the covering and it will stay in the selected position. These systems are called "cordless" systems, meaning systems without operational cords. Further, there are shade systems which are suspended by flexible elements such as suspension cords or strings that are connected with the shade and are used to raise and lower the shade. These systems are called "corded" shade systems meaning shade systems in which the shade is suspended from a suspension cord. Corded shade systems may or may not include operational cords.

Applicants have reviewed the prior art and have found the following art to be representative. U.S. Pat. No. 4,096,903 to Ringle III, discloses an upper channular frame supporting a Venetian blind that houses a rotary shaft parallel to the slats of the blind and from which the slats are suspended by a pair of nylon ladders. The shaft is driven by a small D.C. motor and gear reduction unit having an output governed by limit switches selectively operable to provide a predetermined limit of angular slat movement. The limit switches are incorporated in parallel branches directly in one of the power lines to the motor, with individual diodes controlling the direction of the current through the corresponding branches.

U.S. Pat. No. 4,554,762 to Anderson, discloses a sun blind for motor vehicles including a plurality of horizontally extending slats (2) supported by "ladder" assemblies (4) including rigid side pieces (6) and cross-pieces supporting and locating the slats. An electric motor (10) is connected between the ladder assemblies and a fixed mounting point in such a way that rotation of the motor causes the angle of the slats to be varied. An automatic control circuit opens the blind whenever the ignition of the vehicle is switched on and closes it at a predetermined time after the ignition is switched off.

U.S. Pat. No. 4,618,804 to Iwasaki, discloses a remote control system for bidirectionally rotating an electric motor, such as for opening and closing a blind or the like, comprises a hand-held transmitter including a transmitting circuit capable of developing a forward rotation command signal and a reverse rotation command signal, and a transmitter responsive to each of the command signals for producing a corresponding, predetermined number of infrared pulses for a predetermined amount of time. A receiver and drive unit is operatively coupled with the motor and comprises a receiver responsive to the infrared pulses for developing a corresponding received command signal, a discriminator circuit for determining whether the received command signal corresponds to the command signal for normal rotation or reverse rotation and for producing a corresponding forward rotation or reverse rotation control signal, and a drive circuit responsive to the control signal for causing rotation of the electric motor in the corresponding direction.

U.S. Pat. No. 4,706,726 to Nortoft, discloses a device for the purpose of giving the user of an electric control of a Venetian blind in a window the possibility of adjusting the angular position of the slats independently of raising or lowering the Venetian blind by utilizing an electric motor, spring clutches, and corresponding lift cords, the electric control includes a control circuit with a three position switch controlled by the user. The control circuit is arranged so as to drive the motor at a low speed during a first predetermined time interval for adjusting the angle of the slats and thereafter to drive the motor at an increased speed for raising or lowering the Venetian blind.

U.S. Pat. No. 5,391,967 to Domel, et al. discloses a mini-blind actuator that has a motor and a housing that holds the motor and a dc battery. The rotor of the motor is coupled to the baton of the mini-blind for rotating the baton and thereby opening or closing the slats of the mini-blind. Alternatively, the rotor is coupled to the tilt rod of the blind to rotate the tilt rod and thereby open or close the slats of the mini-blind. A control signal generator generates a control signal for completing the electrical circuit between the battery and the motor. The control signal can be generated in response to a predetermined amount of daylight or in response to a user-generated remote command signal.

U.S. Pat. No. 5,413,161 to Corazzini, discloses a solar powered window shade which consists of a Venetian blind mounted within an interior of a frame of a window in a wall of a building. An apparatus is carried by the Venetian blind, for converting solar radiation of sunlight into electrical energy. A mechanism is carried by the Venetian blind for utilizing the electrical energy to open and close the Venetian blind. At sunrise and all through the day, the Venetian blind will remain opened to allow sunlight to enter through the window, to help heat up the building. At sunset and all through the night, the Venetian blind will remain closed to produce a thermal barrier, to help retain the heat within the building.

U.S. Pat. No. 5,531,257 to Kuhar discloses a cordless, balanced Venetian blind or shade with a constant, or a variable force spring motor that includes conventional window covering components without the outside hanging lifting cords or cord locking mechanisms. One or more spring motors are employed. A cord spool, in the preferred embodiment, is coupled to one of the spring drums to serve to wind the cords to cause the blind to be raised or lowered, simply by manipulation of the bottom bar of the blind system. Due to the spring forces, the system compensates for the increasing weight on the cords as the window covering is raised and for the decreasing weight as it is lowered.

U.S. Pat. No. 5,698,958 to Domel, et al. discloses a mini-blind actuator that has a motor and a housing that holds the motor and a dc battery. The rotor of the motor is coupled to the baton of the mini-blind for rotating the baton and thereby opening or closing the slats of the mini-blind. Alternatively, the rotor is coupled to the tilt rod of the blind to rotate the tilt rod and thereby open or close the slats of the mini-blind. A control signal generator generates a control signal for completing the electrical circuit between the battery and the motor. The control signal can be generated in response to a predetermined amount of daylight or in response to a user-generated remote command signal. The actuator can be used to rotate the slats of horizontal or vertical blinds, or the sections of a pleated shade. Or, the actuator can be used to rotate the hollow rotatable tube of a roll-up shade.

U.S. Pat. No. 5,760,558 to Popat discloses a system for automatic operation of Venetian blinds and similar window coverings. A preferred embodiment, system 30, can be retrofitted to any conventional Venetian blind without tools, removal of the blind, or installation of wiring (FIG. 10A). System 30 is attached to a blind 15 by a bracket 80, which engages a headrail 16 of blind 15, and is secured by a thumbscrew 84 (FIG. 4C). System 30 includes a gear motor 85 which drives a coupling tube 91; coupling tube 91 is attached to a tilt-adjustment shaft 18 of blind 15 (FIG. 3A). The mechanical coupling between gear motor 85 and coupling tube 91 includes a flexible coupling and an extensible coupling, which enable gear motor 85 to rotate shaft 18 over a wide range of sizes and configurations of blind 15 (FIGS. 5A and 5B). System 30 also includes a photovoltaic source 31 mounted on a flexible member 99. Member 99 provides electrical connections to source 31, and supports it in an advantageous position to receive solar radiation (FIGS. 8B and 8C), regardless of the size and mounting arrangement of blind 15. System 30 also includes four momentary-contact electrical switches 38 to 41 and an actuating body 94, to which a tilt-control wand 19 of blind 15 can be attached. Together, actuating body 94 and switches 38 to 41 enable system 30 to be conveniently controlled by rotary and axial movements of wand 19 (FIG. 10A).

U.S. Pat. No. 5,793,174 to Kovach, et al., discloses a wireless battery-operated window covering assembly. The window covering has a head rail in which all the components are housed. These include a battery pack, an interface module including an IR receiver and a manual switch, a processor board including control circuitry, motor, drive gear and a rotatably mounted reel on which lift cords wind and unwind a collapsible shade. The circuitry allows for dual-mode IR receiver operation and a multi-sensor polling scheme, both of which are configured to prolong battery life. Included among these sensors is a lift cord detector which gauges shade status to control the raising and lowering of the shade and a rotation sensor which, in conjunction with internal registers and counters keeps track of travel limits and shade position.

U.S. Pat. No. 5,990,646 to Kovach, et al., discloses a wireless battery-operated window covering assembly. The window covering has a head rail in which all the components are housed. These include a battery pack, an interface module including an IR receiver and a manual switch, a processor board including control circuitry, motor, drive gear and a rotatably mounted reel on which lift cords wind and unwind a collapsible shade. The circuitry allows for dual-mode IR receiver operation and a multi-sensor polling scheme, both of which are configured to prolong battery life. Included among these sensors is a lift cord detector which gauges shade status to control the raising and lowering of the shade and a rotation sensor which, in conjunction with internal registers and counters keeps track of travel limits and shade position.

U.S. Pat. No. 6,259,218 to Kovach, et al. discloses a wireless battery-operated window covering assembly. The window covering has a head rail in which all the components are housed. These include a battery pack, an interface module including an IR receiver and a manual switch, a processor board including control circuitry, motor, drive gear and a rotatably mounted reel on which lift cords wind and unwind a collapsible shade. The circuitry allows for dual-mode IR receiver operation and a multi-sensor polling scheme, both of which are configured to prolong battery life. Included among these sensors is a lift cord detector which gauges shade status to control the raising and lowering of the shade and a rotation sensor which, in conjunction with internal registers and counters keeps track of travel limits and shade position.

U.S. Pat. No. 6,446,693 to Anderson et al. discloses a headrail designed for powered coverings for architectural openings comprising a housing defining an interior that conveniently hides a battery holder, a signal-receiving system, and an electric motor used to adjust the configuration of the covering. The headrail also hides improved hardware for mounting the motor and, in the case of coverings comprising tiltable elements, improved hardware for mounting a tilt rod. Additionally, in the case of coverings comprising tiltable elements, the headrail hides improved hardware for adjustably attaching the tiltable elements to the tilt rod in a manner that prevents over-rotation of the tiltable elements. The battery holder may comprise a battery magazine or a battery carrier removably mounted in the headrail housing. The batteries may be inserted into or extracted from the battery holder through an opening in a bottom wall of the headrail housing. A swingably mounted trap door may selectively cover or uncover the opening. The battery carrier slidingly engages, through the opening in the bottom of the headrail housing, a battery carrier housing that is mounted within the headrail housing. The signal-receiving system includes an exposed signal receiver for receipt of remote-control signals. The present invention also provides a tilt control system with an inexpensive and effective clutch to prevent over-winding of cords onto a control shaft (e.g., a tilt rod) used to control tiltable elements of the covering. The preferred tilt control system also minimizes torque on the motor or other mechanism used to drive the control shaft.

U.S. Pat. No. 6,516,858 to Anderson et al. discloses a headrail including a detachable battery holder for powered coverings for architectural openings. The headrail comprises a housing defining an interior into which a battery magazine is removably mounted. In this manner, the batteries are hidden within the headrail for a more aesthetically pleasing look than can be achieved when the batteries are mounted outside of the headrail. The housing may include one or more small slots into which corresponding tabs on end caps mounted on the ends of the battery magazine may be inserted. The housing may also include a larger opening through which batteries may be inserted into or extracted from the battery magazine while it is mounted in the housing. Further, the housing may include one or more elongated openings for cooling, or through which installed batteries may be inspected, or into which tools may be inserted to move the batteries that are installed in the battery magazine.

U.S. Pat. No. 6,536,503 to Anderson et al. discloses a modular blind transport system for a window blind application. The complete system may be assembled from a relatively small number of individual modules to obtain working systems for a very wide range of applications, including especially a category of counterbalanced blinds wherein a relatively small external input force may be used to raise or lower the blind, and/or to open or close the blind. The primary objective of this invention is to provide a modular blind transport system which overcomes the shortcomings of prior blind transport systems. Rather than having to design a completely new system for each size and weight of blind, the designs of the present invention provide a system comprised of individual modules which are readily interconnected to satisfy the requirements of a multitude of different blind systems, it also includes the individual modules which make the overall system possible.

U.S. Pat. No. 6,655,441 to Wen et al. discloses a friction transmission mechanism for a motor-driven blind that is constructed to include a driving unit, and at least one cord roll-up unit controlled to the driving unit to lift/lower or tilt the slats of the motor-driven Venetian blind. Each cord roll-up unit includes an amplitude modulation wheel controlled by the driving unit to lift/lower the slats and bottom rail of the Venetian blind, a frequency modulation wheel for rotation with the amplitude modulation set to tilt the slats of the Venetian blind, spring elements, which forces the frequency modulation wheel into friction-engagement with the amplitude modulation wheel, and a support supporting the amplitude modulation wheel, the support having a shoulder adapted to act with a protruding block of the frequency modulation wheel and to further limit angle of rotation of the frequency modulation wheel.

U.S. Pat. No. 6,736,186 to Anderson et al. discloses a headrail designed for powered coverings for architectural openings comprises a housing defining an interior that conveniently hides a battery holder, a signal-receiving system, and an electric motor used to adjust the configuration of the covering. The headrail also hides improved hardware for mounting the motor and, in the case of coverings comprising tiltable elements, improved hardware for mounting a tilt rod. Additionally, in the case of coverings comprising tiltable elements, the headrail hides improved hardware for adjustably attaching the tiltable elements to the tilt rod in a manner that prevents over-rotation of the tiltable elements. The battery holder may comprise a battery magazine or a battery carrier removably mounted in the headrail housing. The batteries may be inserted into or extracted from the battery holder through an opening in a bottom wall of the headrail housing. A swingably mounted trap door may selectively cover or uncover the opening. The battery carrier slidingly engages, through the opening in the bottom of the headrail housing, a battery carrier housing that is mounted within the headrail housing. The signal-receiving system includes an exposed signal receiver for receipt of remote-control signals. The present invention also provides a tilt control system with an inexpensive and effective clutch to prevent over-winding of cords onto a control shaft (e.g., a tilt rod) used to control tiltable elements of the covering. The preferred tilt control system also minimizes torque on the motor or other mechanism used to drive the control shaft.

U.S. Pat. No. 6,795,226 to Agrawal, et al. discloses a transparent chromomeric assembly in which color changes are selectively effectible over predefined areas comprises a pair of facing transparent substrates (15, 21, 28) each covered with a conductive layer divided into individual energizeable areas each provided with a set of bus bars (187, 188). A passive layer may be superimposed over one of the substrates, its color being chosen so that the color and the transmissivity of the passive layer accommodates the range of color change and transmissivity of the electrochromic layer to maintain the transmitted color of the panel in a warm or neutral shade. Various other chromomeric windows, devices and systems are also disclosed.

U.S. Pat. No. 6,850,017 to Domel et al. discloses a mini-blind actuator that has a motor and a housing that holds the motor and a dc battery. The rotor of the motor is coupled to the baton of the mini-blind for rotating the baton and thereby opening or closing the slats of the mini-blind. Alternatively, the rotor is coupled to the tilt rod of the blind to rotate the tilt rod and thereby open or close the slats of the mini-blind. A control signal generator generates a control signal for completing the electrical circuit between the battery and the motor. The control signal can be generated in response to a predetermined amount of daylight or in response to a user-generated remote command signal. The actuator can be used to rotate the slats of horizontal or vertical blinds, or the sections of a pleated shade. Or, the actuator can be used to rotate the hollow rotatable tube of a roll-up shade.

U.S. Pat. No. 6,867,565 to Maistre, et al. discloses a process that contains the following steps: entering a teaching mode, defining and recording zero, one or two limit of travel positions, exiting the teaching mode, determining the number and the type of the limits of travel produced by end stops, if there exists at least one limit of travel produced by virtue of an end stop, detecting and recording the position of the end stops.

U.S. Pat. No. 6,957,683 to Toti discloses a spring drive system useful for window covers which comprises one or more coil spring drives or flat spring drives and the combination whose elements are selected from one or more of a group which includes (1) a band or cord transmission which provides varying ratio power transfer as the cover is opened and closed; (2) gear means comprising various gear sets which provide frictional holding force and fixed power transfer ratios; (3) a gear transmission which provides fixed ratio power transfer as the cover is opened or closed; (4) crank mechanisms; (5) brake mechanisms; and (6) recoiler mechanisms. The combination permits the spring drive force to be tailored to the weight and/or compression characteristics of an associated window cover such as a horizontal slat or pleated or box blind as the cover is opened and closed.

U.S. Pat. No. 7,389,806 to Kates discloses an electronically-controlled roll-up window shade that can easily be installed by a homeowner or general handyman. The motorized shade includes an internal power source, a motor, and a communication system to allow for remote control of the motorized shade. One or more motorized shades can be controlled singly or as a group. In one embodiment, the motorized shades are used in connection with a zoned or non-zoned HVAC system to reduce energy usage. In one embodiment, the motorized shade is configured to have a size and form-factor that conforms to a standard manually-controlled motorized shade. In one embodiment, a group controller is configured to provide thermostat information to the motorized shade. In one embodiment, the group controller communicates with a central monitoring system that coordinates operation of one or more motorized shades. In one embodiment, the internal power source of the motorized shade is recharged by a solar cell.

In all of the references of which Applicants are aware, motorized shades are complex systems very different from manual systems and, thus, the user at the time of purchase must decide then whether the situation calls for a manual or a motorized system. Further, not all products from a particular company include manual and motorized options. Thus, a user may need to choose a motorized system from one manufacturer and a manual system from another if they want both types of units. Then, of course, many times the products from different manufacturers do not match in appearance.

Applicants have found that a need in the art exists for a manual shade that is "motorizable". As used herein, the term "motorizable" refers to a system that operates as a manual shade but is conformed such that the manual system includes elements required so that it is easily converted to a mechanical, motorized, system. Further, there is a need in the art for manual shade systems which include operational cords to be able to eliminate the operational cords and to convert the system to a mechanical, motorized system.

It, therefore, is an object of this invention to provide a shade system that can be purchased and installed as a manually operated system but that is quickly and easily converted to a motorized system by an ordinary consumer without need for tools and special equipment. It is a further object of the invention to provide a manual shade system that is motorizable with or without operational cords. It is a still further object of the invention to provide a motorizable shade that is also quickly and easily converted from a motorized shade to a manual shade.

SUMMARY OF THE INVENTION

Accordingly, the motorizable shade system of the present invention, according to one embodiment includes a header system where the header system includes an integral header attachment connection. At least one cord spool is provided within the header system and is connected with at least one suspension cord. A shade is suspended from the at least one suspension cord. A motor assembly attachment connection is provided in a motor assembly that is conformed to connect with the integral header attachment connection and the motor assembly includes a motor assembly electrical connector. A power system is provided with a power attachment connection that is also conformed to connect with the integral header attachment connection and the power system includes a power system electrical connector conformed to connect with the motor assembly electrical connector.

As used herein, the term "header system" refers to the header or head rail of shade systems as that term is known and used in the art. Typically, a header system includes the header, a "C-shaped" enclosure that encompasses a shade, shade roll, cords, cord spools, and other operational parts of a shade system. A separate header cover is also often part of a header system but may or may not be included. The header cover may be movable or removable so that access to the operational parts of the shade system is provided. Further the header cover hides the operational parts within the header from view.

Also, the term "integral" is used herein to describe a structural element that is a part of the structure itself. Metal extrusions and plastic forms, for example only, may be created to include catches and guides in the form itself. In the present invention the "integral header attachment connection" identifies an important element of the invention in that the header system itself is formed with the requisite structure to provide the required attachment element. The term also alludes to the fact that the manual shade system of the present invention includes all the features necessary for a user to quickly transform the manual shade to a motorized shade without having to add any screws, bolts, wires and the like.

Also, as used herein, the term "cord spool" refers to any type of cord roll up unit such as a spool or a translating tube or the like. Further the term "cord" includes cords, string and the like and any flexible element now known or hereafter developed. Still further, "shade" refers to any flexible covering.

Further, as used herein the term "electrical connector" describes a device or combination of devices used in enabling the transmission of electricity from element to another. As described herein, an electrical connector consists of an exposed electrical carrier, such as a copper wire, for example only, in combination with an electric contact in a device. In this system electricity passes indirectly though the carrier to the electric contact and to the device. This system is illustrated in FIGS. 2-11 and 14-20 in two separate manners in which the header system acts as the carrier. In another embodiment, an electrical connector consists of an extended electrical connector on one device that joins directly with an electrical connector on a power source. This system is illustrated in FIGS. 12 and 13.

In one aspect of the invention the header system acts as a positive voltage carrier and a negative voltage carrier. In another aspect of the invention, an operational cord is connected with the shade. In another aspect, a counter balance system is connected with the cord spool.

In a further aspect, the motor assembly includes a motor, a control board, an encoder and a drive adapter. A first contact and a second contact are connected with the motor assembly such that the first contact is connected with the positive voltage carrier and the second contact is connected with the negative voltage carrier when the motor assembly is located within the header system. Also, the at least one cord spool includes a cord spool shaft and the drive adapter is connected with the cord spool shaft such that movement of the drive adapter by the motor moves the cord spool shaft.

In another aspect, an insulator is provided in the header system between the positive voltage carrier and the negative voltage carrier. In one aspect, the first contact and the second contact are biased springs.

In other aspects, an antenna is connected with the control board for remote activation of the motor assembly and in one aspect more than one cord spool is provided where each cord spool is connected to a suspension cord.

According to another embodiment, a motorizable shade system consists of a header system including a header and a header cover where the header system acts as a positive voltage carrier and a negative voltage carrier and where the header system includes an integral header attachment connection. A battery housing is connected with the header system and with one or the other of the positive voltage carrier and the negative voltage carrier. A cord spool is provided within the header and it is connected with at least one suspension cord and a shade is suspended from the at least one suspension cord.

In one aspect of this invention, a counter balance system is provided within the header and is connected with the cord spool.

In another aspect, the invention includes a motor assembly conformed to fit within the header system where the motor assembly includes a motor, a control board, an encoder and a drive adapter and where the motor assembly includes a motor assembly attachment connection conformed to connect with the header attachment connection. A first contact and a second contact are connected with the motor assembly where the first contact is connects with the positive voltage carrier and where the second contact connects with the negative voltage carrier when the motor assembly is inserted into the header system. The cord spool includes a cord spool shaft and the drive adapter is connected with the cord spool shaft such that movement of the drive adapter by the motor moves the cord spool shaft.

In other aspects of the invention, an operational cord is connected with the shade, an antenna is connected with the control board for remote activation of the motor, a timer is connected with the control board, and/or the first contact and the second contact are biased springs.

According to another embodiment, a method for motorizing a shade system includes the steps of: providing a header system where the header system includes an integral header attachment connection, at least one cord spool within the header system connected with at least one suspension cord, and a shade suspended from the at least one suspension cord; providing a motor assembly attachment connection in a motor assembly that is conformed to connect with the integral header attachment connection and where the motor assembly includes a motor assembly electrical connector and a drive adapter; and providing a power system with a power attachment connection conformed to connect with the integral header attachment connection and where the power system includes a power system electrical connector conformed to connect with the motor assembly electrical connector; where the cord spool includes a cord spool shaft and the drive adapter is connected with the cord spool shaft when the motor assembly is installed within the header system such that movement of the drive adapter by the motor assembly moves the cord spool shaft; then connecting the motor assembly attachment connection and the power attachment connection with the integral header attachment connection and then connecting the motor assembly electrical connector with the power system electrical connector In another aspect, the motor assembly includes a control board that activates the motor assembly in response to input from a group of inputs consisting of: a predetermined amount of daylight, user generated remote signals, and a tug on said shade.

In one aspect, a timer is connected with the motor assembly where the control board includes a time threshold for movement of the shade from an open position to a closed position.

In a further aspect, the time threshold for movement is detected by the control board, the control board signals a stop to the motor and then starts the motor and returns the shade to a fully open position.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
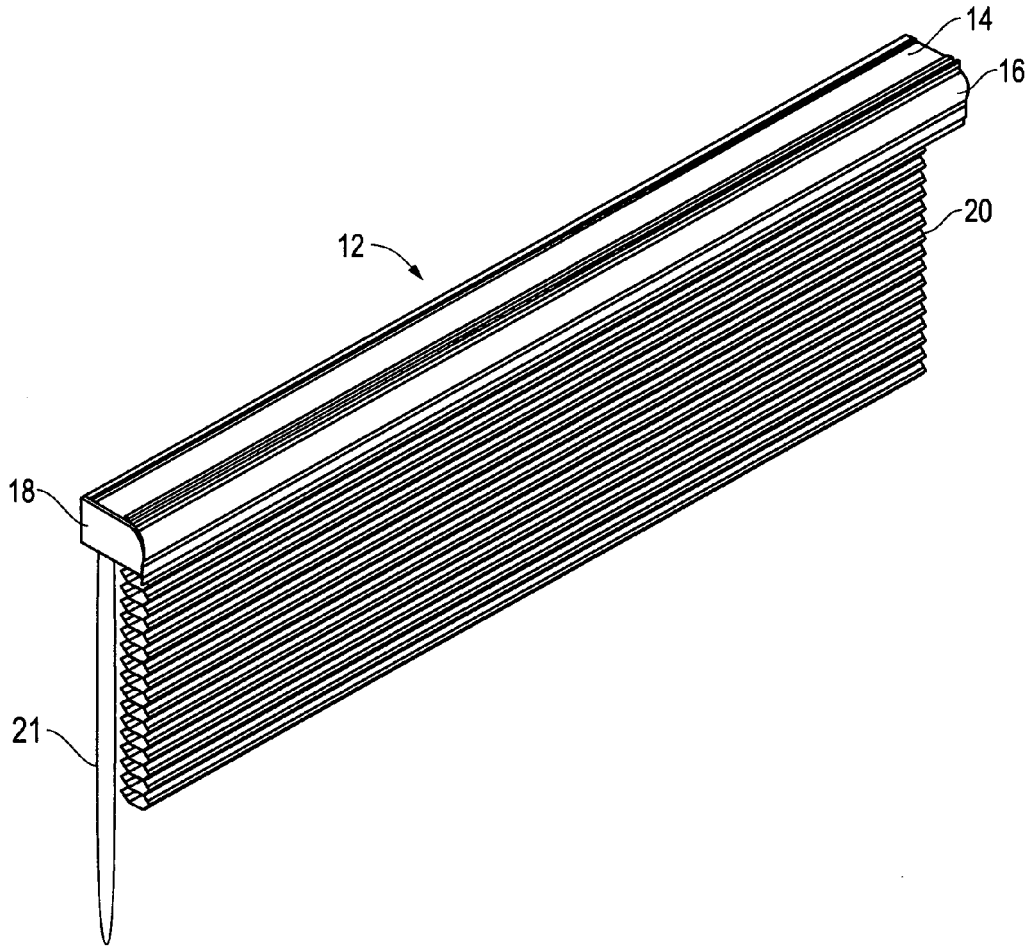
FIG. 1 (Prior Art)
FIG. 1 is a prior art representation of some of the features of a typical shade system.

The preferred embodiment of the present invention is illustrated by way of example in FIGS. 2-20. FIG. 1 is an illustration of what a typical shade system looks like from the outside, both the prior art and the present invention. That is, FIG. 1 shows a header system 12 that includes a header 14 and a front header cover 16. Typically, header 12 is C-shaped and includes end caps 18. In combination, header 14, header cover 16 and end caps 18 completely enclose and hide from view whatever is inside of the header system 12.

FIG. 1 also illustrates a shade 20. In this case shade 20 is shown as a cellular shade. It is understood that any and all types of shades now known, such as roman shades, pleated shades, Venetian blind shades, or any shades hereafter developed are included in the term shade.

Further, FIG. 1 shows operational cord 21. Operational cord 21 functions to raise and lower and tilt shade 20 forward or backward, all as is known in the art.

Figure 2:
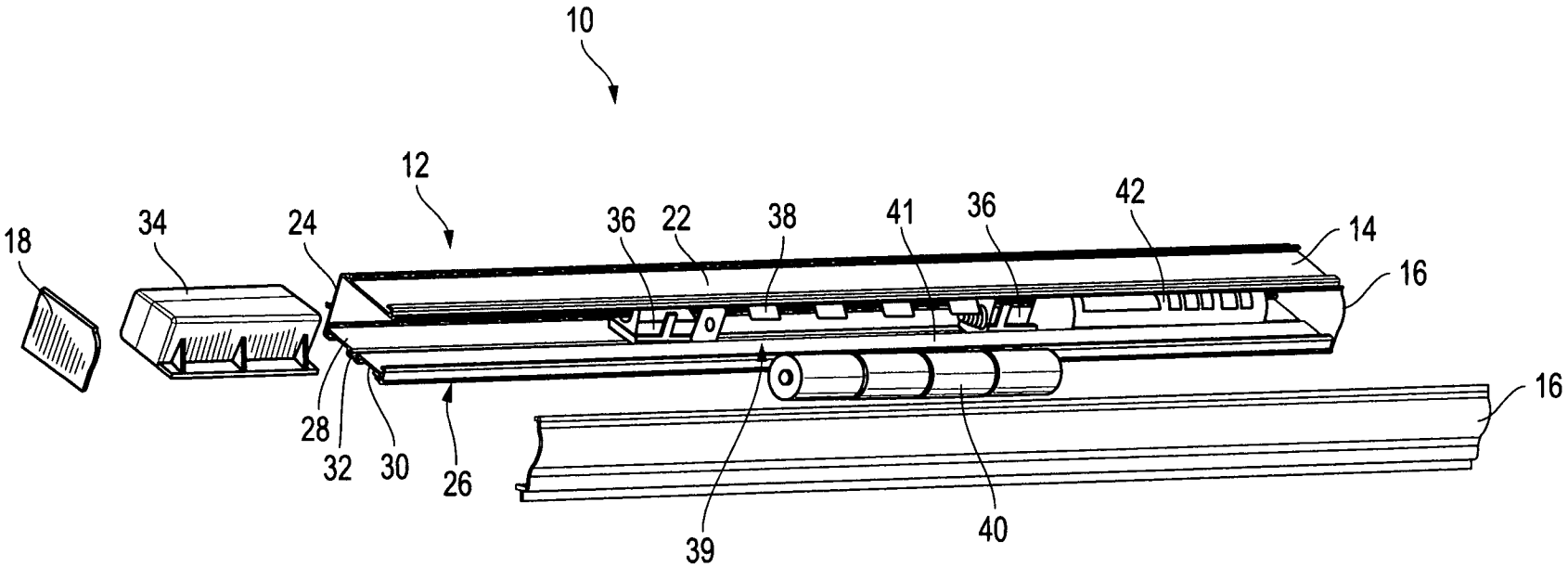
FIG. 2 is a perspective, exploded view of the motorizable shade system of the present invention according to one embodiment.

Referring now to FIG. 2, the motorizable shade system 10 of the present invention according to one embodiment includes a header system 12, which includes a header 14 and may or may not include a header cover 16. It can be clearly seen in this figure that, again as is typical, header 14 is C-shaped and includes a top 22, a back 24 and a bottom 26. End caps 18 are also shown.

Importantly, FIG. 2 also shows positive voltage carrier 28 and negative voltage carrier
formed into the bottom 26 of header 14 as will be more fully discussed hereafter. At this point it is important to know that any part of header system 12 is appropriate for locating positive voltage carrier 28 and negative voltage carrier 30. That is, they could be located in the top 22, back 24 or header cover 16 or a combination thereof all in accordance with the scope of the invention. FIGS. 14-20, for example illustrate, among other things, the embodiment where the electrical voltage carriers are in the back 24 and the bottom 26 of header 14, for example only. For purposes of example only, therefore, and not by way of limitation, FIG. 2 shows both electrical conductive legs formed into and made a part of the bottom 26 of header 14.

As used herein, the terms "formed into" and "made a part of" are used to define a structure that is an "integral" structure such that header system 12 itself is the positive voltage carrier 28 and the negative voltage carrier 30. The term "voltage carrier" is used to describe a device that transmits current such as an exposed metal wire. Copper wire for example, but not by way of limitation, may be formed into a thin sheet and formed into the surface of the header system. The entire thin sheet then becomes an electrical carrier capable of transmitting current. According to this embodiment of the present invention, the voltage carriers are integral to the header system 12 and are present in the manual, non-motorized, version of the invention. Their presence, along with other features of the invention as will be described hereafter, enable the manual shade to be quickly and easily made into a motorized shade without need for adding extraneous and obstructive wires and the like.

Insulator 32 is also illustrated. Insulator 32 is any insulator now known or hereafter developed for electrically insulating positive voltage carrier 28 from negative voltage carrier 30.

FIG. 2 also shows motor assembly 34, spool housing(s) 36, battery housing 38, batteries 40, and counter balance 42. Battery housing 38 and batteries 40 make up the power system 39 of the present invention. Power system 39 includes a power attachment connection 41 as will be described more fully with regard to FIG. 6.

Figure 3:
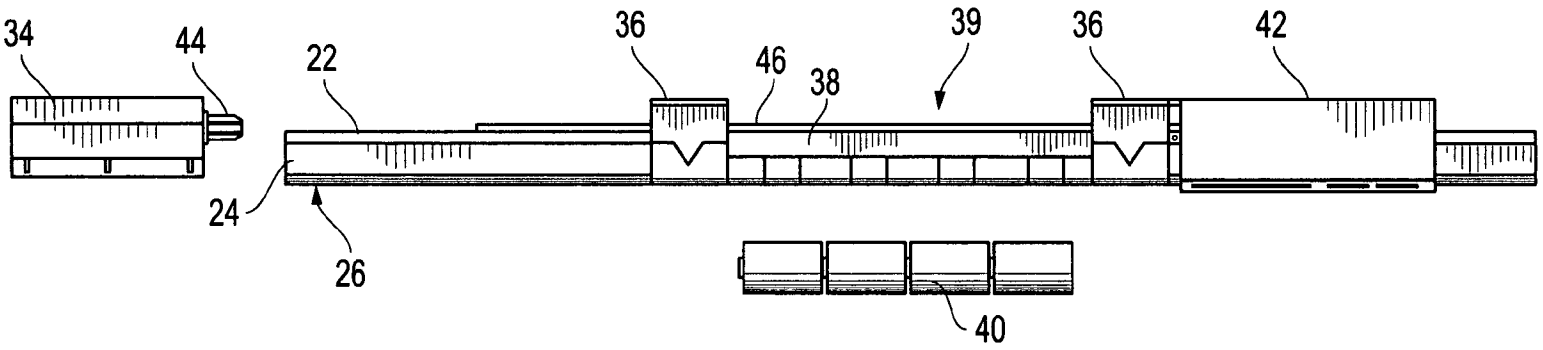
FIG. 3 is a top view of the invention of FIG. 2 with part of the header and the header cover removed for clarity showing the motor assembly removed from the header system.
Figure 4:
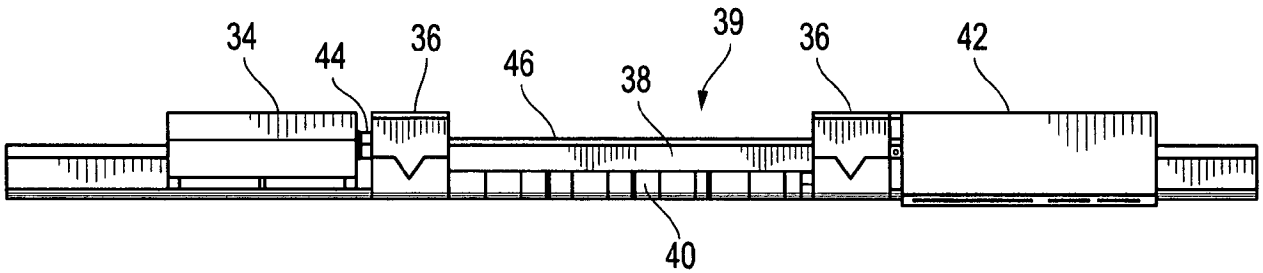
FIG. 4 is a front view of the invention of FIG. 2 with part of the header and the header cover removed for clarity showing the motor assembly within the header system.

Referring now to FIGS. 3 and 4, FIG. 3 shows the motor assembly 34 removed from the header system 12 and illustrates the drive adaptor 44 which is part of motor assembly 34. Drive adaptor 44 is conformed so as to connect with drive shaft 46 which is connected with the cord spool 48 (not shown but shown in FIGS. 8 and 9).

FIG. 4 shows motor assembly 34 inserted within header system 12 and with drive adaptor 44 connected with drive shaft 46 such that upon operation of the motor assembly 34, drive adaptor 44 turns drive shaft 46 and that turns cord spool 48.

Figure 5:
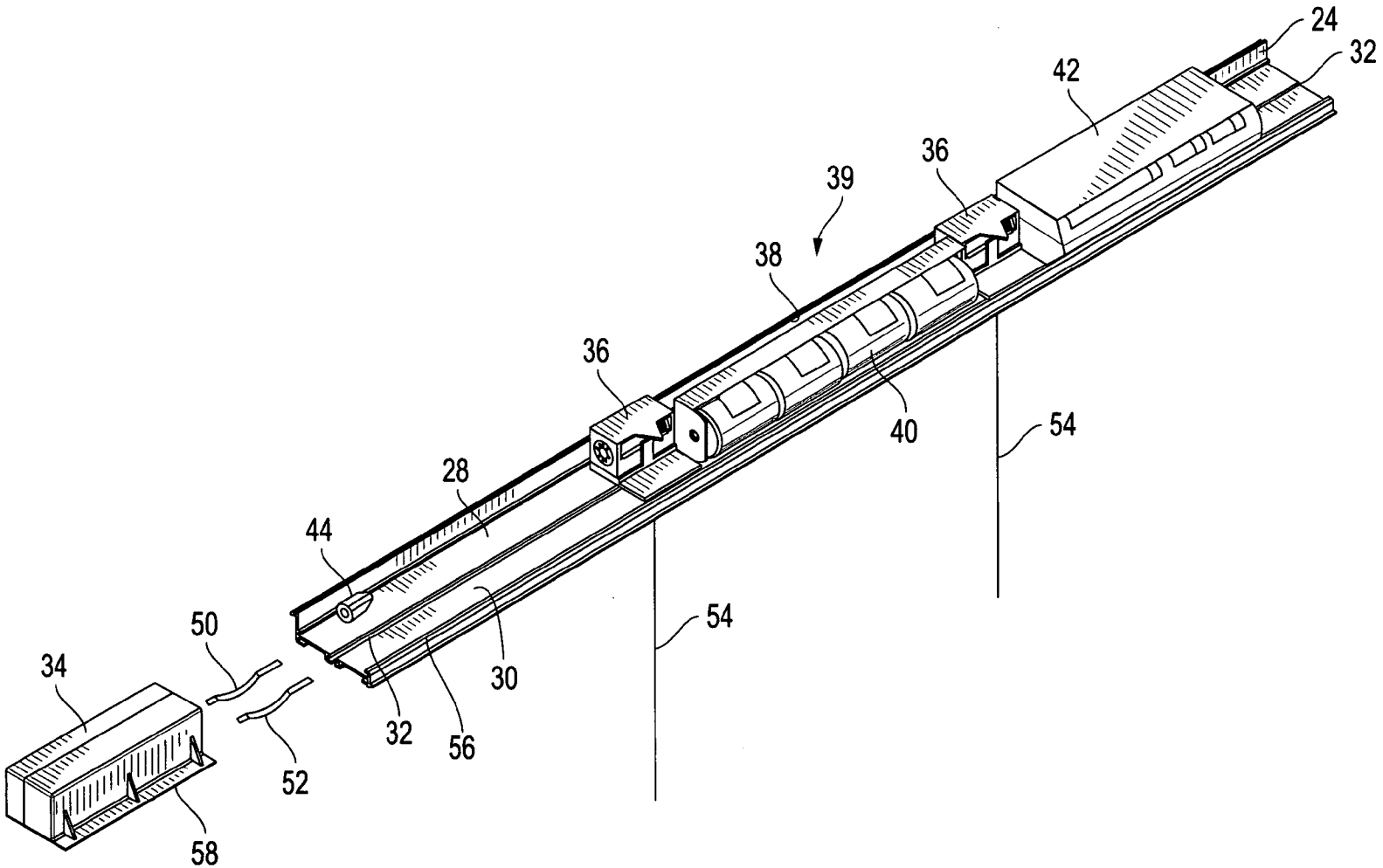
FIG. 5 is a perspective view of the invention of FIG. 2 with part of the header and the header cover removed for clarity and showing the power contacts of the motor assembly.

Referring now to FIG. 5, this partially exploded perspective view shows an important element of motor assembly 34, first contact 50 and second contact 52. These contacts provide the connection between the motor assembly 34 and the positive voltage carrier 28 and the negative voltage carrier 30, as will be discussed more fully hereafter.

Also illustrated are suspension cord(s) 54. There are two illustrated but only one or many more may be needed depending on the size of shade 20 (not shown). Suspension cord(s) 54 are connected with the cord spool 48 on one end and with the shade 20 (not shown, see FIG. 8) on the other. As the name suggests, suspension cord 54 is the cord from which the shade 20 is suspended. As the shade 20 is raised, suspension cord 54 is rolled up on cord spool 48 and as the shade 20 is lowered, suspension cord 54 is unwound from cord spool 48. Certainly, other means and methods for taking up and releasing suspension cord 54 as the shade 20 is raised and lowered are included within the scope of this invention.

Figure 6:
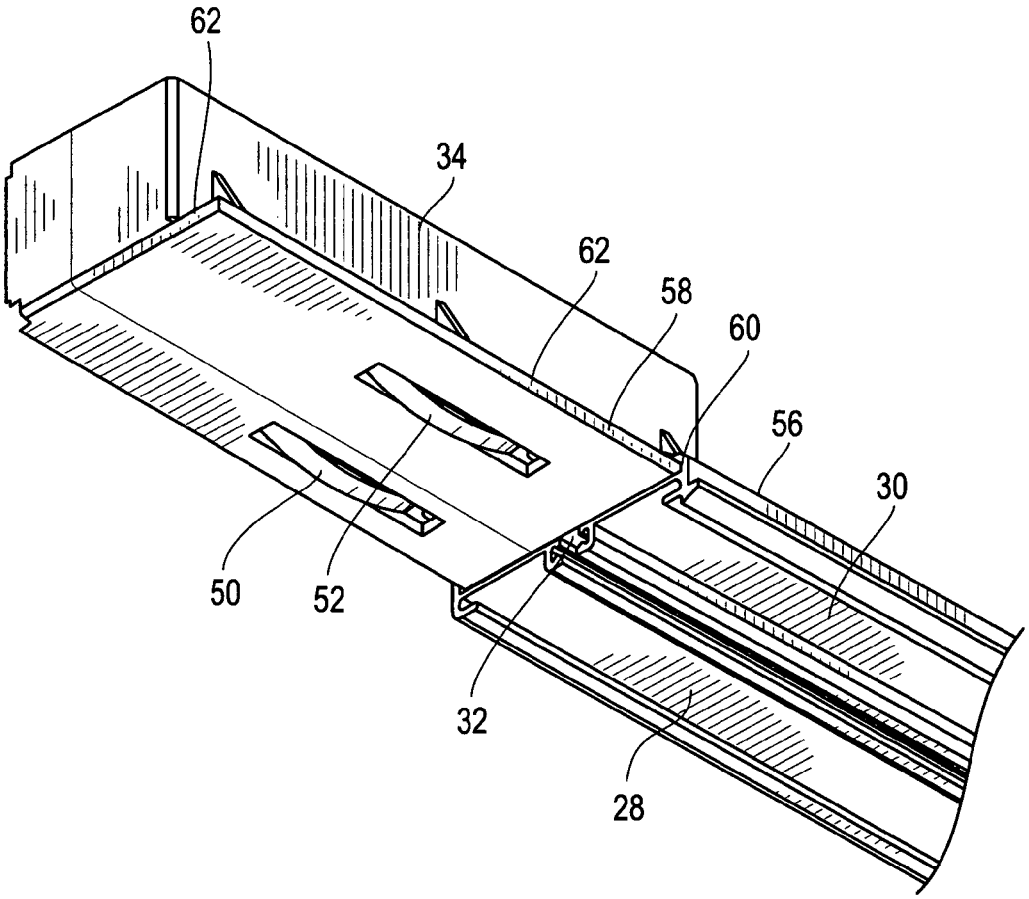
FIG. 6 is a bottom, partial perspective view showing the motor assembly and the positive and negative voltage carriers and an insulator.

Referring now to FIG. 6, important features of the present invention are shown in detail. In particular, FIG. 6 shows first contact 50 and second contact 52 as they are connected to the motor assembly 34. As such, again, first contact 50 comes into contact with and makes an electrical connection with positive voltage carrier 28 and second contact 52 comes into contact with and makes an electrical connection with negative voltage carrier 30 when, and only when the user desires to "motorize" the manual shade system 10. When motor assembly 34 is inserted within header system 12 the electrical connections are made.

In one aspect of the invention, first contact 50 and second contact 52 are "biased springs" that resist compression and thus maintain tight contact when compressed. This compression is accomplished, for example only and not by way of limitation, by the use of the leaf spring contacts, 50 and 52, in combination with an integral header attachment connection 56 in the header system 12 and a motor assembly attachment connection 58 in the motor assembly 34.

For the purpose of example only and not by way of limitation, integral header attachment connection 56 in the header system 12 consists of an overhanging lip 60 and motor assembly attachment connection 58 in the motor assembly 34 consists of an extended edge 62. Extended edge 62 is captured within overhanging lip 60 as motor assembly 34 is inserted into header system 12. This keeps motor assembly 34 securely connected with header assembly 12 such that biased spring connectors, first contact 50 and second contact 52, are compressed as the motor assembly 34 is inserted into the header system 12 and thus kept pressed tightly against positive voltage carrier 28 and negative voltage carrier 30. In the same way and with the same elements, power system 39 is easily and securely connected with header system 12 by means of power attachment connection 41 in the form of extended edge 62 (See FIG. 2).

Certainly other forms of integral header attachment connections 56 and motor assembly attachment connections 58 and power attachment connections 41 as may be desired are included within the scope of the invention. FIGS. 14-20 illustrate another form of integral header attachment connection 56 and motor assembly and power attachment connections 58 and 41, for example only, as will be described more fully hereafter.

Figure 7:
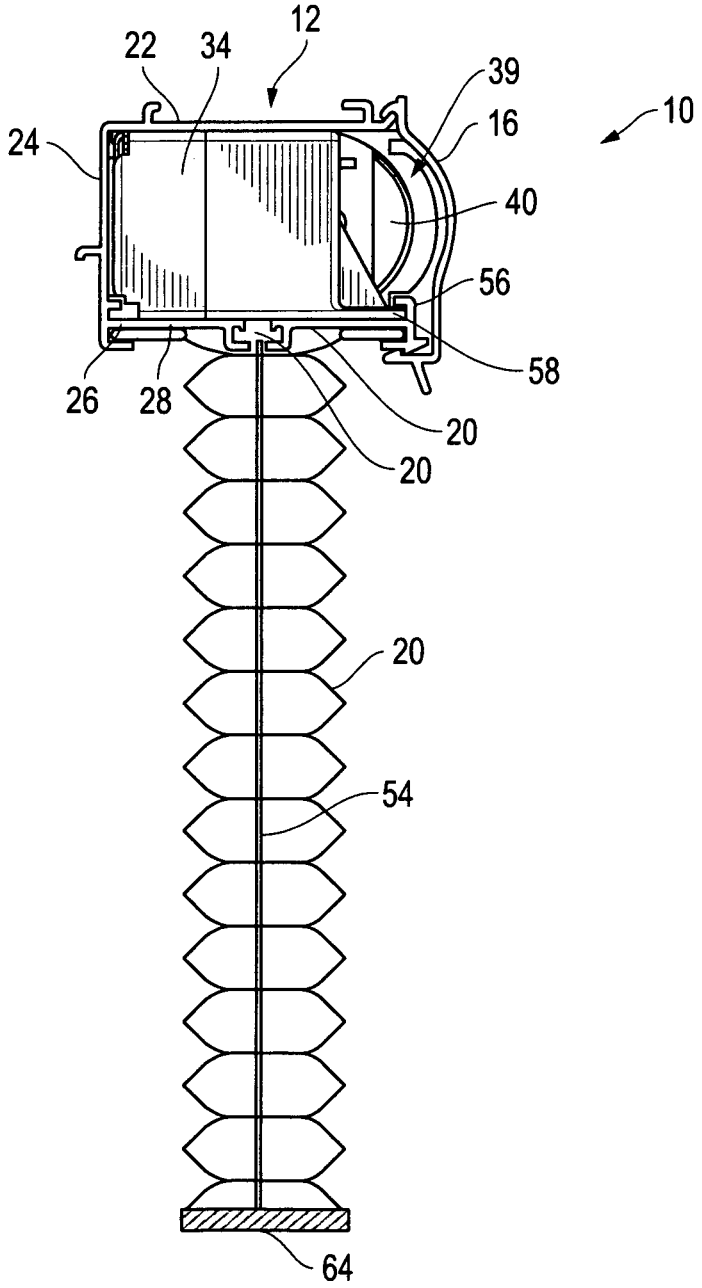
FIG. 7 is a side end view of the invention of FIG. 2.

Referring now to FIG. 7, a side end view of the invention shows header system 12 with the end cap 18 removed. Motor assembly 34 and power system 39 are held in place by the combination of integral header attachment connection 56 and motor assembly attachment connection 58 (and power attachment connection 41 hidden behind motor assembly 34 and not shown) thus ensuring secure and continuous contacts with the voltage carriers, 28 and 30. Importantly, this header attachment connection is preformed and integral to the manually operable shade of the present invention. It is in place, in other words, and available to safely and simply convert a manual shade to a motorized shade, or vice versa, when desired.

FIG. 7 also shows suspension cord 54 connected with shade 20 at the bottom of shade 20. Typically, an "end bar" 64 is provided at the bottom of a shade system to add rigidity and weight to the bottom of shade 20. Other means and methods are, of course, known.

Figure 8:
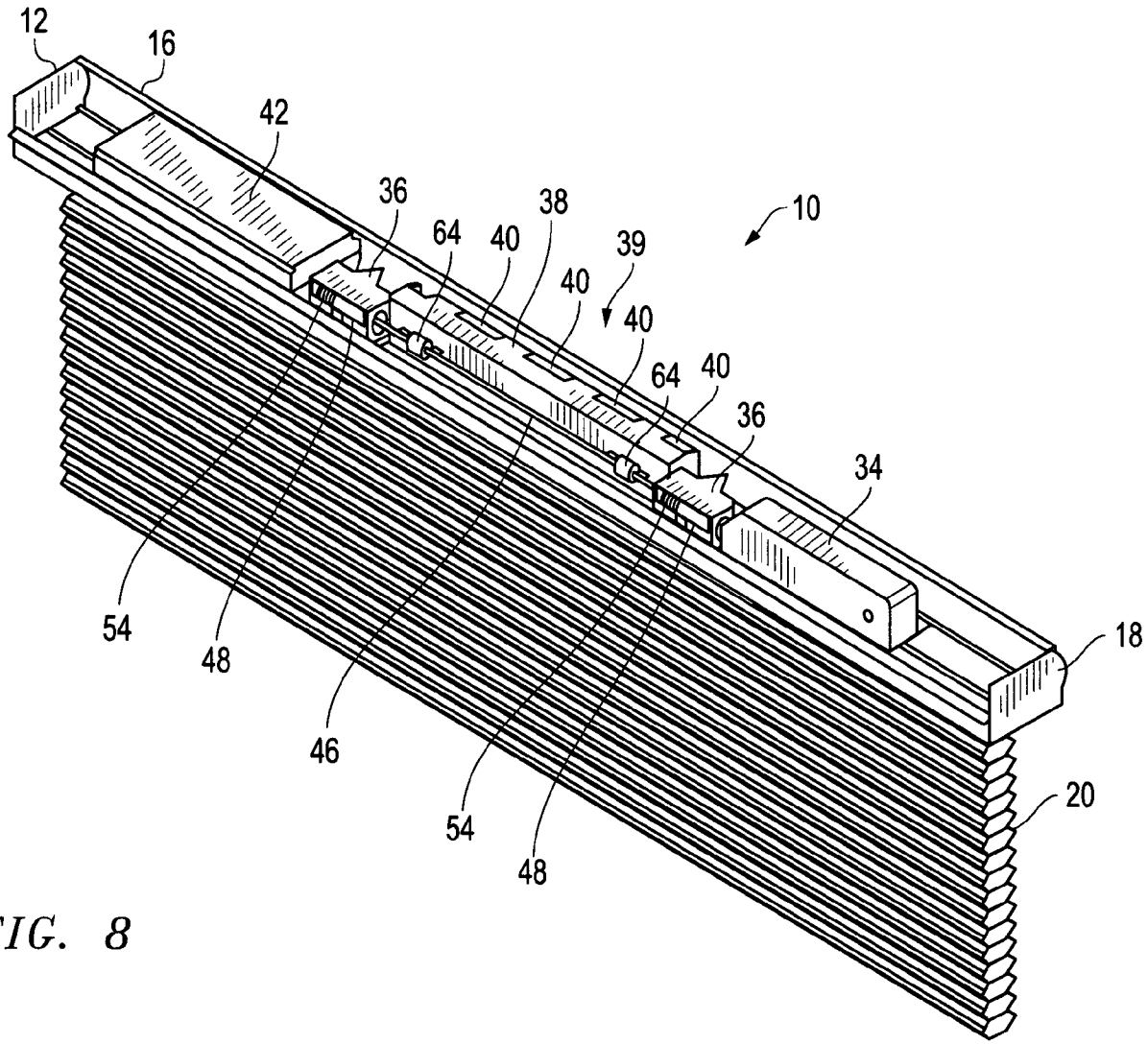
FIG. 8 is a back view of the invention of FIG. 2 with some of the header removed for clarity.

Referring to FIG. 8, a perspective, partial cut away view, from behind the motorizable shade system 10 is presented. The top 22 and back 24 of header 14 have been removed for clarity. Here cord spools 48 are shown with suspension cords 54 connected with them and partially wound upon them. Also shown are shaft supports 64 attached to the back of battery housing 38, when in place within the header system 12, for supporting the drive shaft(s) 46 of the cord spool(s) 48.

It should be noted, again, that FIG. 8 shows a motorizable shade system 10 which the user has converted into a motorized shade system by the addition of the power system 39 in the form of battery housing 38 which makes electrical contact with one or the other of the positive voltage carrier 28 or the negative voltage carrier 30. Batteries 40 provide the power to the carrier that is transmitted to the motor assembly 34 which enables a user to mechanically operate the previously manual shade system 10. It is contemplated that battery housing 38 may be part of the manual shade system and then the only need is to add batteries 40 to complete the required power system 39 to power the circuit.

FIG. 8 also shows counter balance 42. The useful features of a counter balance are known in the art and one may or may not be included in the motorizable shade system 10 of the present invention. If present, obviously, drive shaft 46 is connected with counter balance 42.

Figure 9:
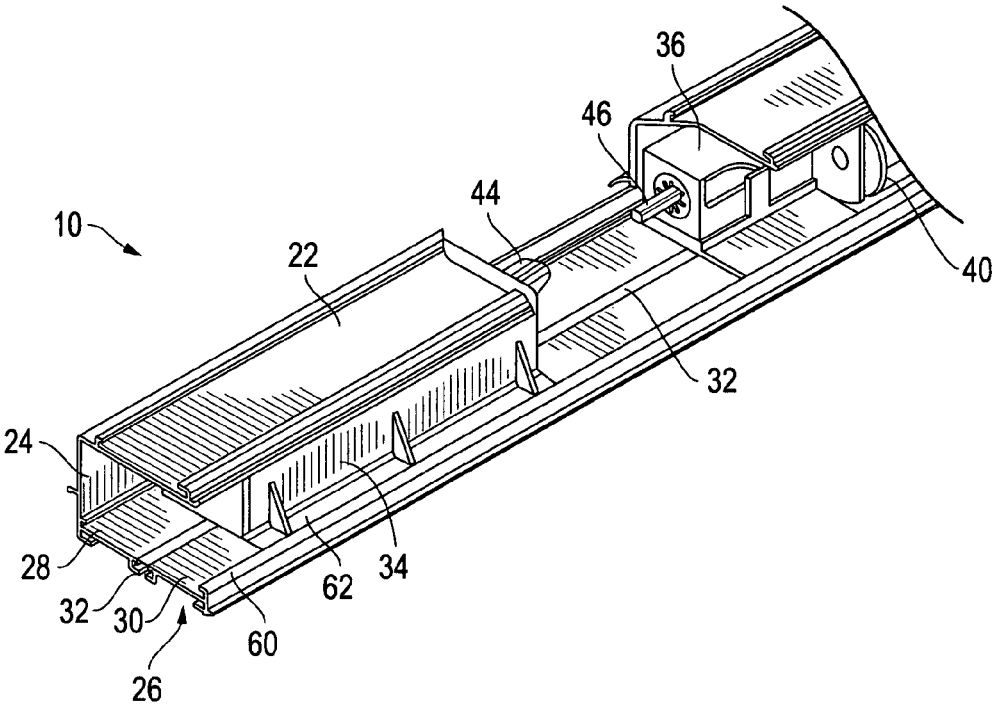
FIG. 9 is a partial perspective view with some of the header cut away for clarity showing the motor assembly being added to the invention.
Figure 10:
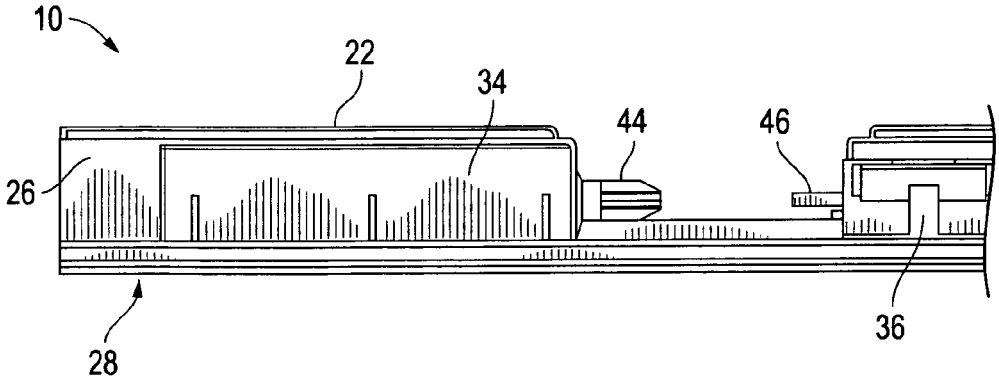
FIG. 10 is a front view of the invention of FIG. 9.

Referring now to FIGS. 9 and 10, these partial cut away views show motor assembly 34 inserted partially within header system 14. They clearly show drive adaptor 44 and the exposed end of drive shaft 46. When connected, again, movement of the drive adaptor 44 results in movement of drive shaft 46.

FIG. 9 also shows, again, positive voltage carrier 28 and negative voltage carrier 30 as part of the bottom 26 of header 14 with insulator 32 in between them. Again, this orientation is for example only and not by way of limitation. Another embodiment, for example only, is as illustrated hereafter in FIGS. 14-20.

Figure 11:
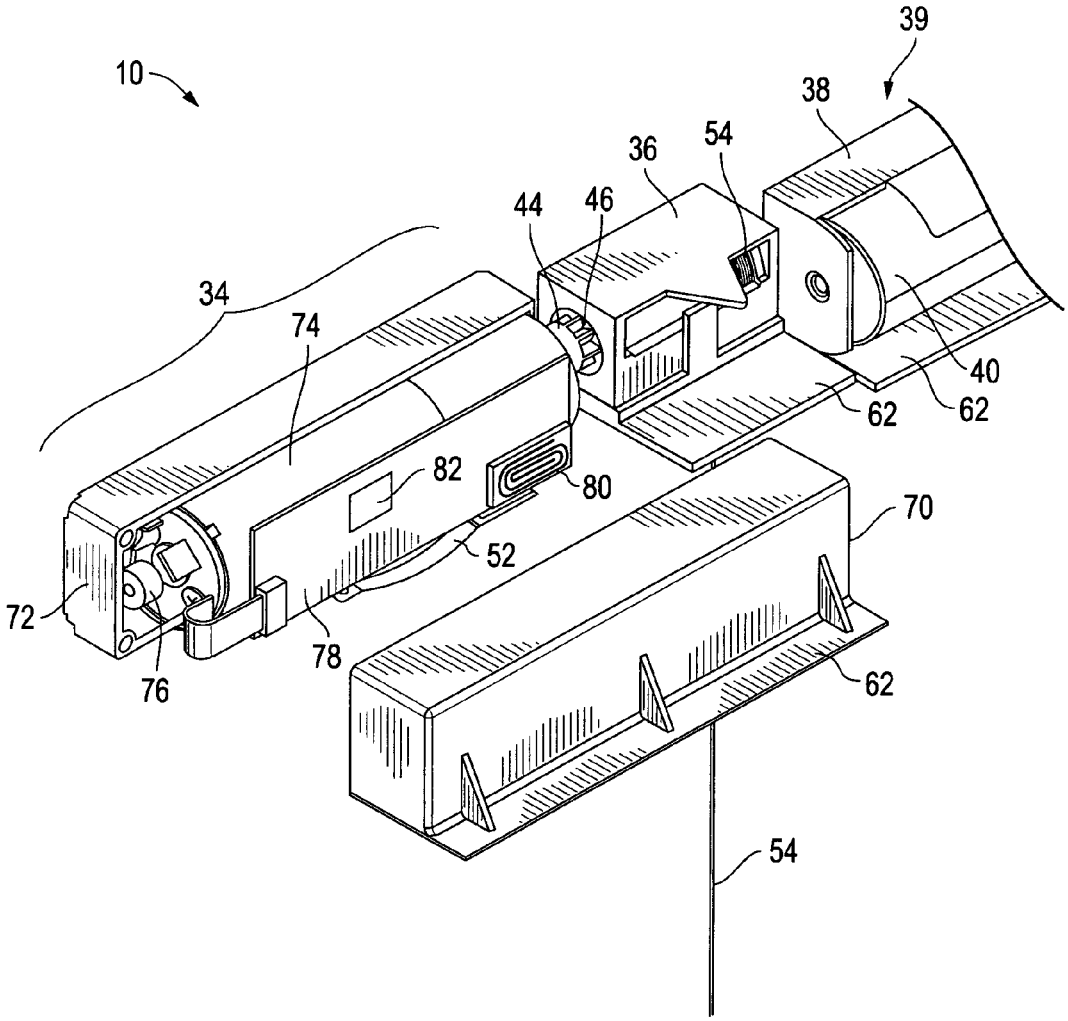
FIG. 11 is a partial exploded view of the invention of FIG. 2 showing the motor assembly with its cover removed.

Now referring to FIG. 11, additional details of the invention are illustrated. Here it is shown that motor assembly 34 includes a motor assembly housing 68 that is formed from the combination of a front housing 70 and a back housing 72. Within the motor assembly housing 68 are found motor 74, an encoder 76, a control board 78 and the portion of drive adaptor 44 connected within the motor assembly housing 68 to the motor 74. Also shown is an antenna 80 and a timer 82. Obviously this combination of elements is illustrative and more or fewer elements may be appropriate according to the needs of the user.

The elements within motor assembly housing 68 function in manners known in the art and require no detailed explanation. In general however, encoder 76, when present, tracks the location of shade 20 relative to header system 12 and the lowest position of the end bar 64. Once known, the shade 20 may be mechanically manipulated within those limits by means of control board 78. Many manipulations are anticipated but a useful manipulation is the tracking of the time threshold for movement of the shade 20 with timer 82 and the detection of this time threshold by the control board 78. For example, when the batteries 40 are fully charged the raising and/or lowering of the shade 20 takes a certain amount of time that is noted. Thereafter, as the batteries 40 discharge the time increases. Once a time threshold indicates the batteries 40 are almost depleted, the control board 78 activates the shade 20 one last time and raises it up to the header system 12 leaving the shade 20 in a fully open position (See FIG. 14 for example) and signaling thereby the need to replace the batteries 40. Many other manipulations are possible as well, of course.

Antenna 80 is capable of receiving RF signals from a remote sending device (not shown) for the hands free operation of the motorizable shade system 10 of the present invention once it is in fact motorized.

Figure 12:
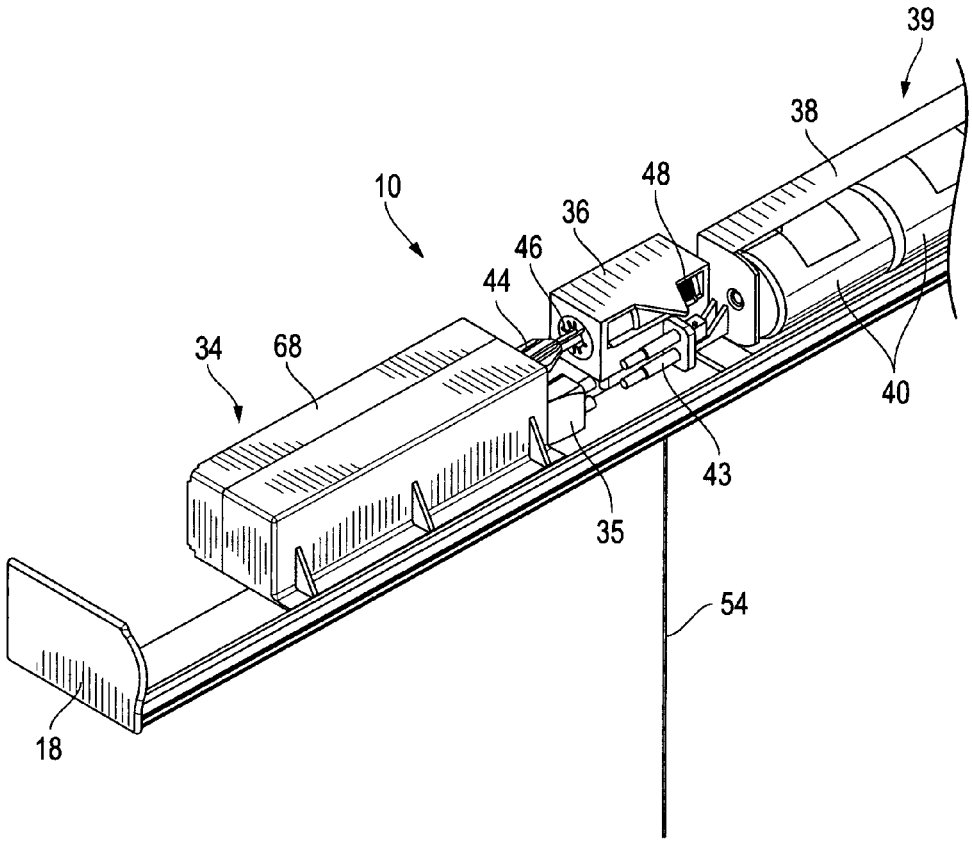
FIG. 12 is a perspective partial cut away view of the invention of FIG. 2 showing one embodiment of the electrical connectors on the motor assembly and power system.
Figure 13:
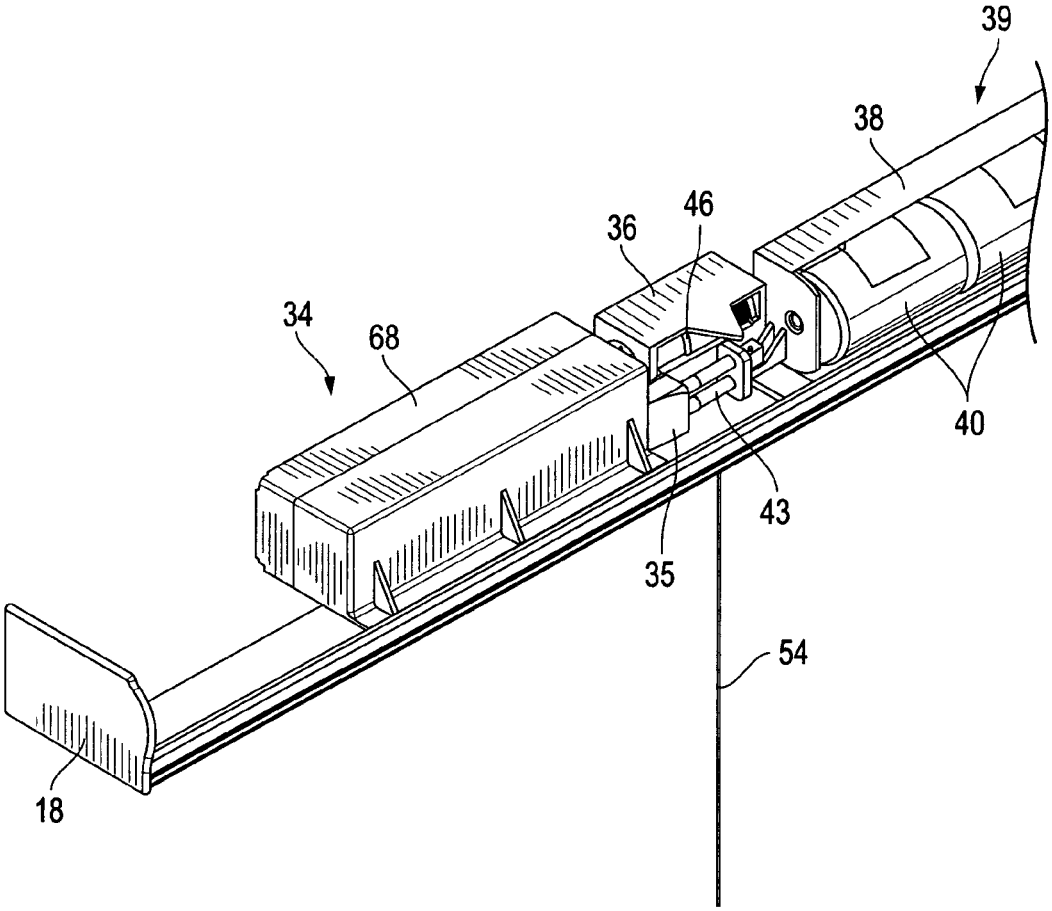
FIG. 13 is a view of the invention as shown in FIG. 12 with the electrical connectors connected with each other.

Now referring to FIGS. 12 and 13, another important element of the invention is illustrated in which a motorizable shade system 10 is provided without integral electrical conductors in the header system 12 as described herein with reference to FIGS. 2-11 and 14-20. FIGS. 12 and 13 show motor assembly electrical connector 35 and power system electrical connector 43. While any system that enables the connection of the motor assembly 34 with the power system 39 simply by inserting the two elements into header system 12 is included within the scope of the invention, FIGS. 12 and 13 show a preferred embodiment. In this embodiment, motor assembly electrical connector 35 is shown in FIG. 12 connected with motor assembly 34 and extending some distance away from the motor assembly housing 68. As motor assembly 34 is inserted within header 14, motor assembly electrical connector 35 is brought closer and closer to power system electrical connector 43. Power system electrical connector 43 is connected with power system 39 and extends some variable distance away from power system 39.

FIG. 13 shows the connection of motor assembly electrical connector 35 and power system electrical connector 43. The connection is long enough between the two elements to bridge the length of spool housing 36. Obviously, electrical connectors 35 and 43 may be made in any connectable manner as in the plug and plug receptor manner illustrated. Just as obviously, electrical connectors may be any length deemed needed and useful.

Figure 14:
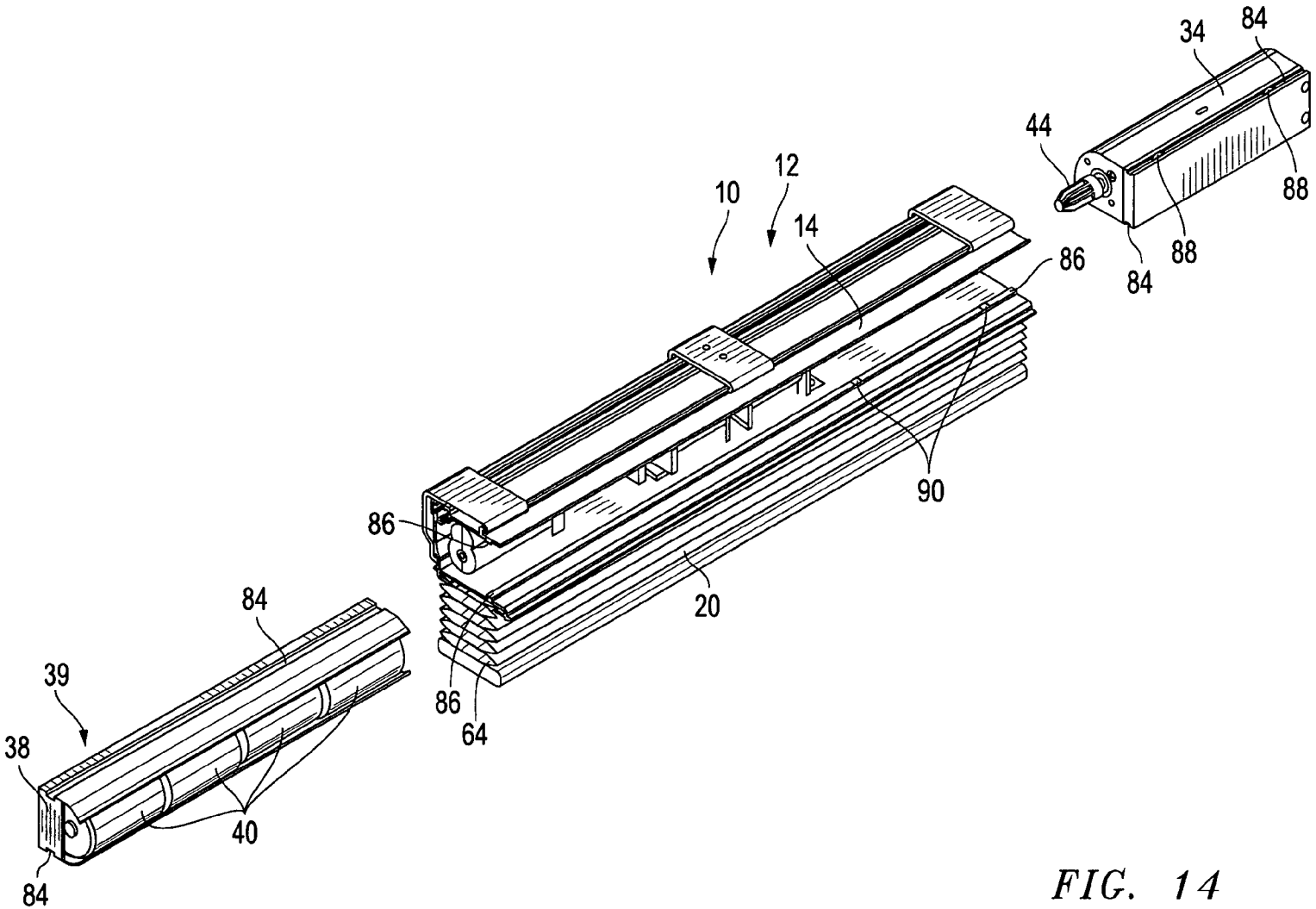
FIG. 14 is an exploded perspective view of the motorizable shade system of the present invention according to another embodiment.

Referring now to FIG. 14, another attachment connection system is described in which the motor assembly 34 and the power system 39 include slots 84 and the header 14 includes integral protrusion 86. Integral protrusions 86 run the length of the header 14 on, preferably, both the inside of the top 22 and bottom 26 of header 14. Likewise, preferably, motor assembly 34 and power system 39, battery housing 38 specifically, include slots 84 along the length of both of the exterior surfaces of each as illustrated. In this manner, motor assembly 34 and power system 39 may be positioned anywhere along the integral protrusions 86. Again, this illustrates another embodiment of the required integral header attachment connection 56 and the motor assembly attachment connection 58 and the power attachment connection 41 as described above.

FIG. 14 also shows another element of the invention in the form of biased leads 88 in motor assembly 34 which cooperate with recesses 90 in header 14 to hold motor assembly 34 in place when biased leads 88 expand into and are captured by recesses 90.

Figure 15:
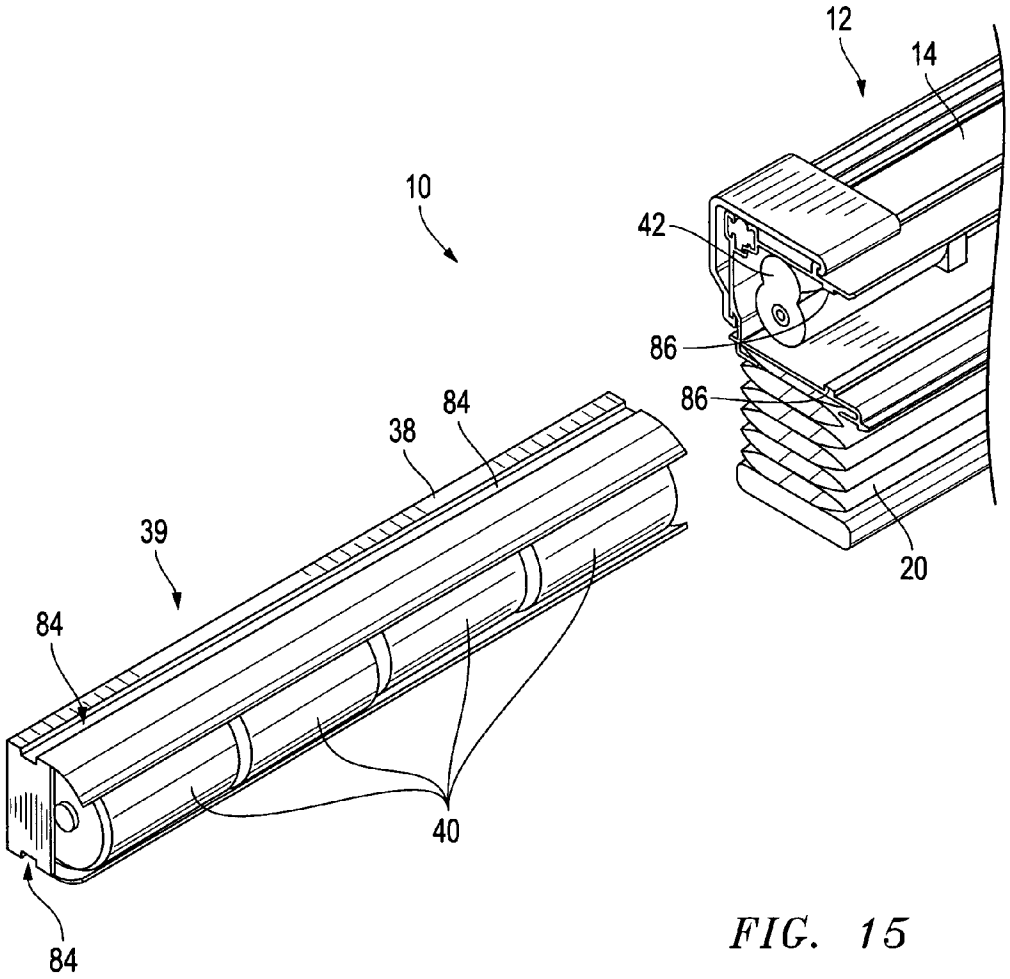
FIG. 15 is an enlarged perspective view of the left side of the invention of FIG. 14 showing the batteries can be inserted from either end of the header system.
Figure 16:
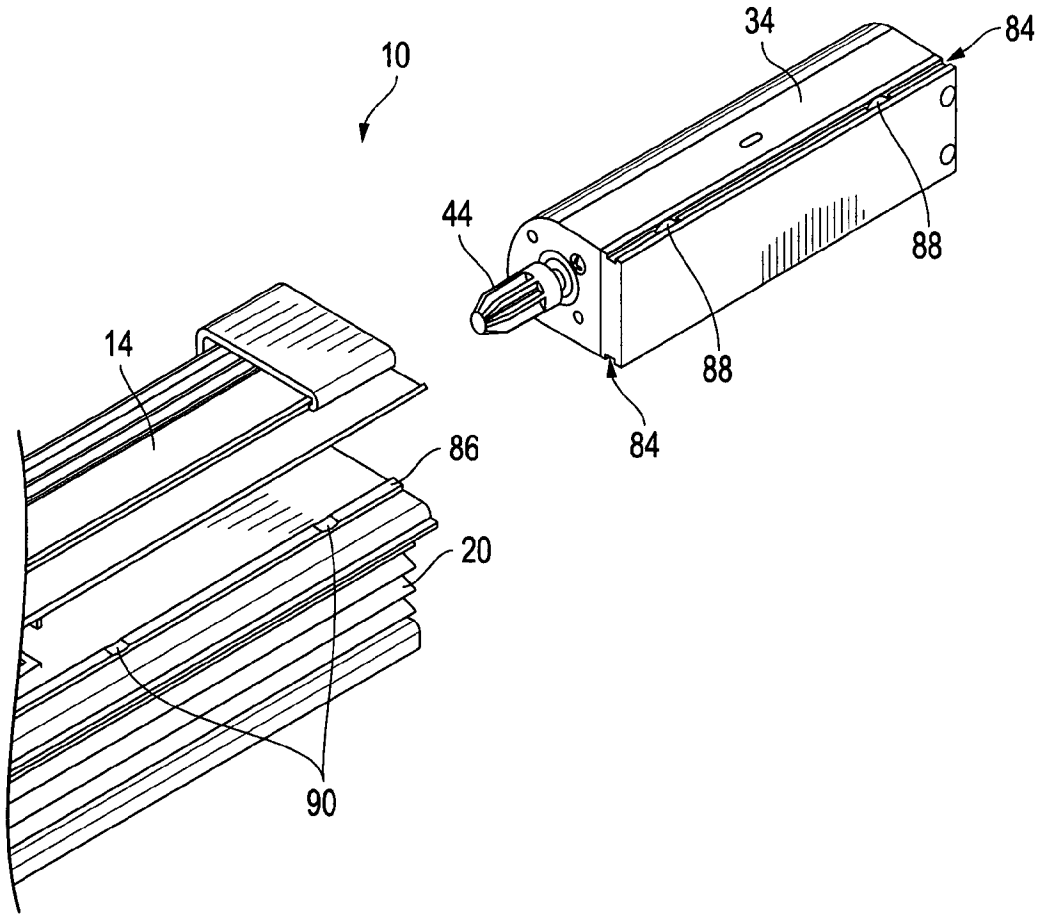
FIG. 16 is an enlarged perspective view of the right side of FIG. 14.

FIG. 15 provides a detailed, close up view of the elements of FIG. 14 on the left side of FIG. 14 and FIG. 16 provides a detailed, close up view of the elements of FIG. 14 on the rights side of FIG. 14.

Figure 17:
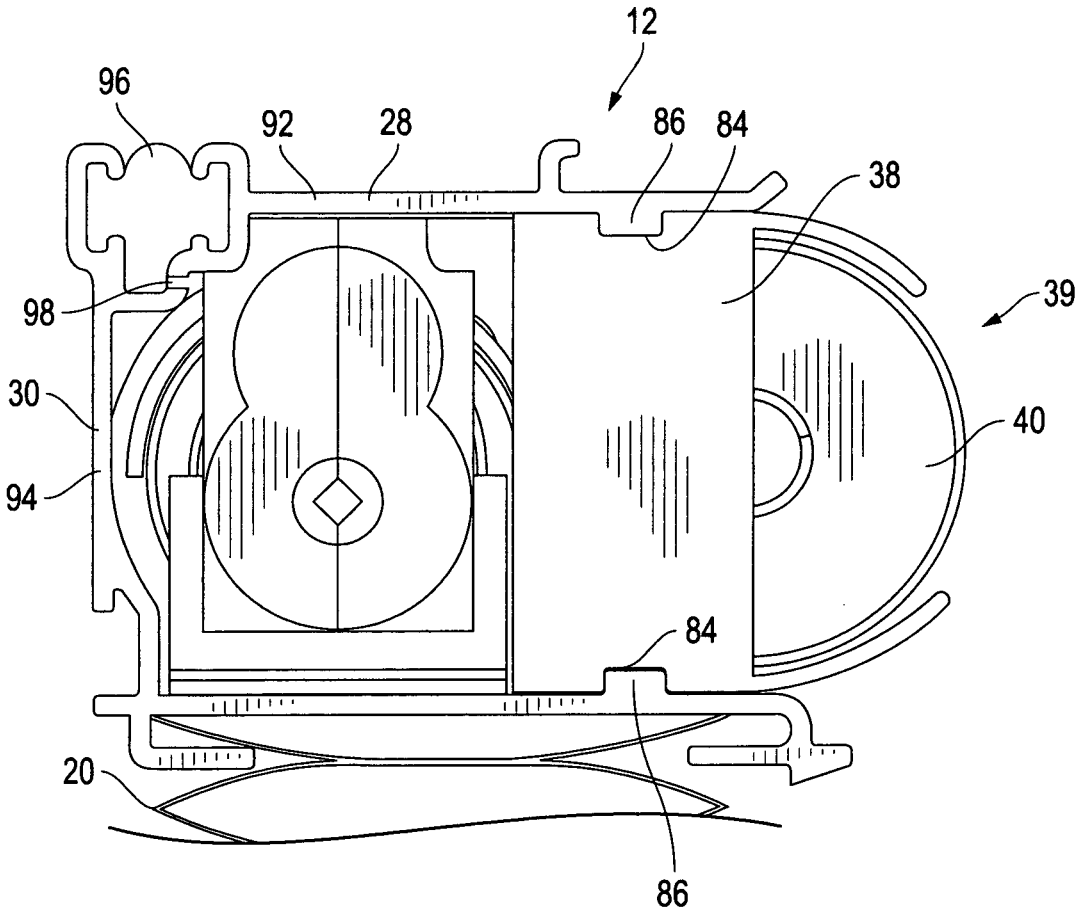
FIG. 17 is an end view of the invention with end cap and front cover removed.

Referring now to FIG. 17 another embodiment of the invention is illustrated. In this end view, two separate electrical carriers 92 and 94 are created in header system 12. In this example, the top 22 of header 14 is connected with the back 24 such as by adhesive 96, for example only.

This connection, however, provides for a separating, insulating slot 98 between top 22 and back 24. Electrical carriers 92 and 94, positive voltage carrier 28 and negative voltage carrier 30, for example, are formed thereby. This, as with the embodiment described with reference to FIGS. 2-11 above, creates two isolated conductive paths that are integral to the manually operable shade system and thus are readily available for use in motorizing the manual shade system.

Figure 18:
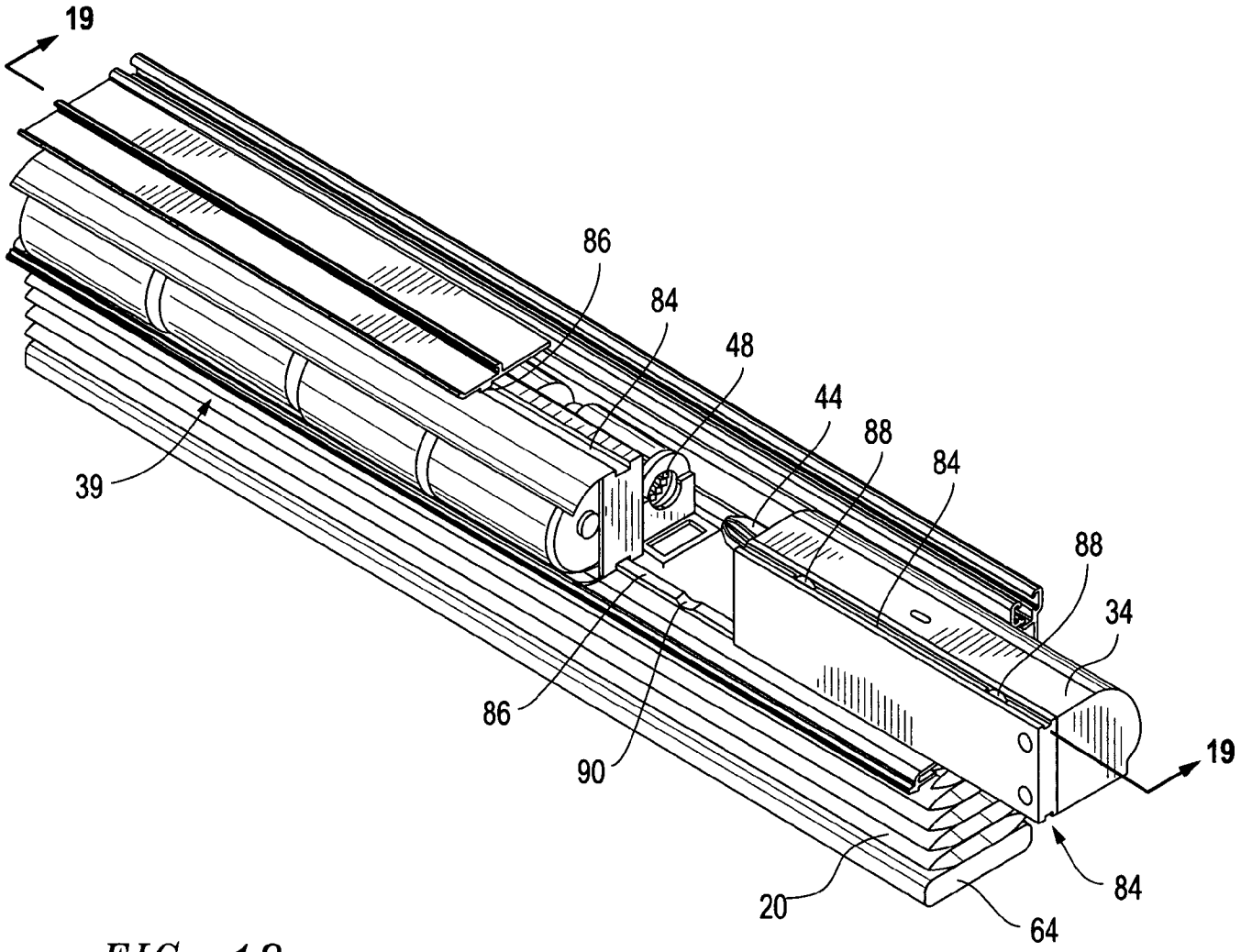
FIG. 18 is an opposite perspective partial section view showing the motor assembly being inserted within the header.

FIG. 18 is an opposite perspective, partial cut away view showing the motorizable shade system 10 of the present invention either transforming from a manual shade, with motor assembly 34 and power system 39 being added or being transformed to a manually operable shade system with these elements being removed.

Figure 19:
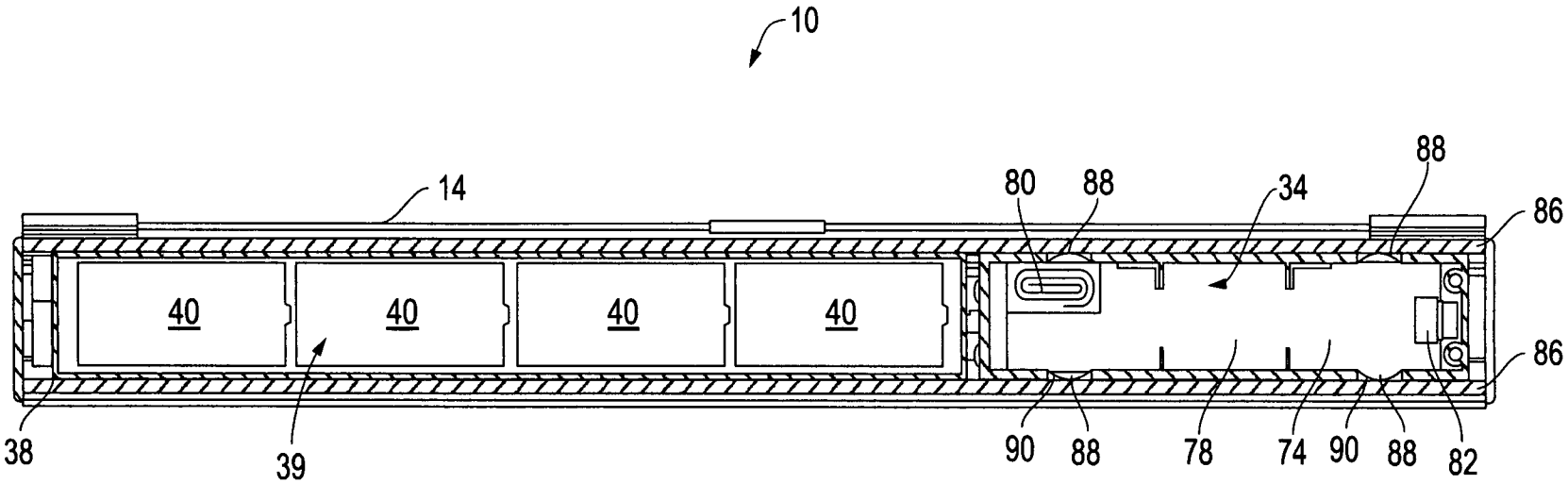
FIG. 19 is a front section view taken along lines 19-19 in FIG. 18.
Figure 20:
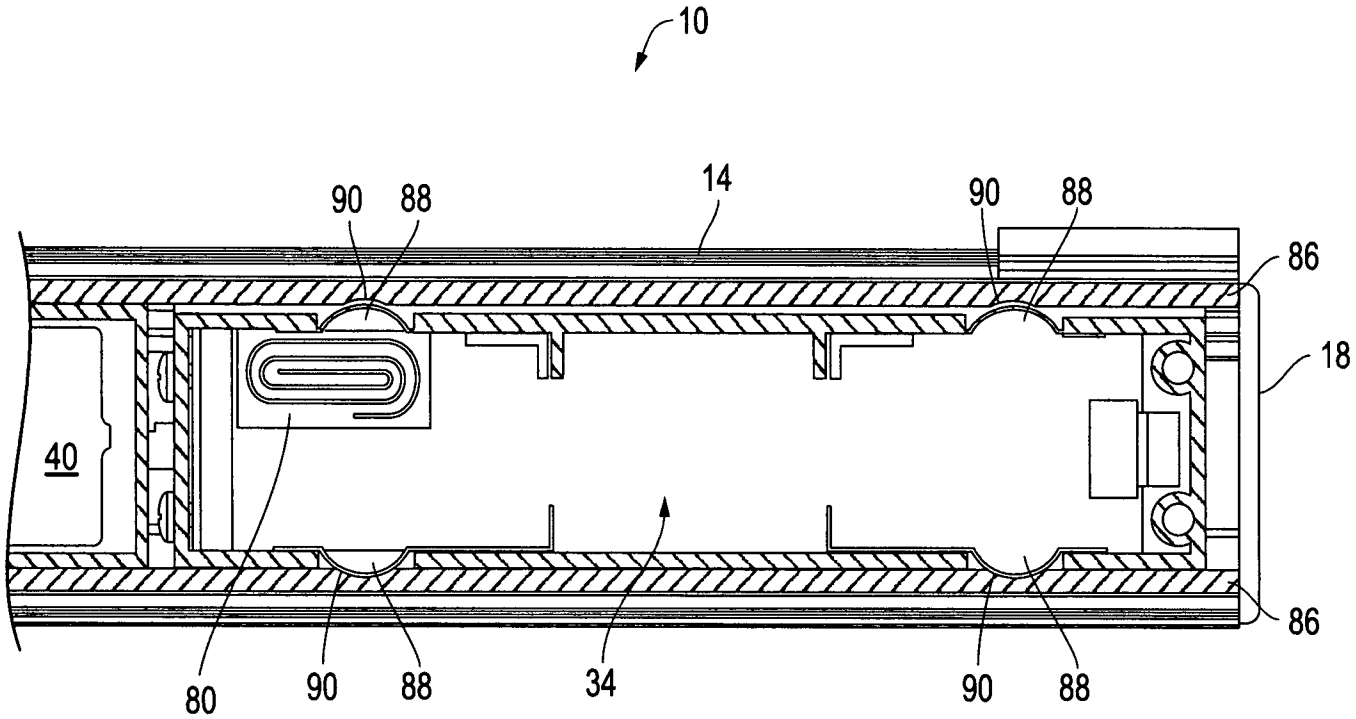
FIG. 20 is an enlarged view of the right hand side of FIG. 19.

FIG. 19 is a section view taken along lines 19-19 in FIG. 18 and FIG. 20 is an enlarged view of the right side of FIG. 1.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A motorizable shade system comprising:

a header system with an inside and an outside, wherein the header system includes an integral header attachment connection, wherein the integral header attachment connection comprises a preformed guide on the inside of the header system;

at least one cord spool connected with a drive shaft positioned within the header system, the at least one cord spool connected with at least one suspension cord;

a shade suspended from the at least one suspension cord;

a motor assembly having a motor assembly attachment connection to removably connect with the integral header attachment connection such that the motor assembly is selectively added to and removed from the header system along the preformed guide;

a power system operably connected with the motor assembly, wherein the power system includes a plurality of batteries which supply power to the motor assembly;

a counter balance system positioned within the header system and connected with the drive shaft, wherein the counter balance system provides a counter balance force to the drive shaft to counter balance weight of the shade;

wherein when the motor assembly is added to the header system and operably connected with the driveshaft, the shade operates by the motor assembly; and wherein when the motor assembly is removed from the header system, the shade operates manually.

2. The system of claim 1 wherein the motor assembly is added to the header system, the motor assembly slides into the header system from an open end of the header system along the preformed guide such that the integral header attachment connection engages the motor assembly attachment connection thereby forming a slidable connection.

3. The system of claim 1 wherein the motor assembly is added to the header system to convert the shade system from a manual shade to a motorized shade by sliding the motor assembly into the header system from an open end of the header system along the preformed guide.

4. The system of claim 1 wherein the counter balance system slides into the header system from an open end of the header system along the preformed guide.

5. The system of claim 1 wherein the motor assembly includes a motor, a control board, an encoder and a drive adapter; and wherein the at least one cord spool slidably receives the drive adapter such that movement of the drive adapter by the motor moves the at least one cord spool.

6. The system of claim 1 further including an antenna connected with a control board of the motor assembly for remote activation of the motor assembly wherein the antenna is connected on or in the motor assembly.

7. The system of claim 1 wherein the motor assembly includes a motor, a control board and an encoder, wherein the encoder tracks the position of the shade relative to the header system.

8. A motorizable shade system comprising:

a header system including a header and a header cover, the header having an inside and an outside and extending a length between open ends;

the header having an integral header attachment connection, wherein the integral header attachment connection comprises a preformed guide on the inside of the header;

a motor assembly, the motor assembly having a motor assembly attachment connection to removably connect with the integral header attachment connection such that the motor assembly is selectively added to and removed from the header system along the preformed guide;

a battery housing operatively connected with the motor assembly and positioned within the header;

a drive shaft positioned within the header;

the drive shaft having a first cord spool and a second cord spool, a first suspension cord connected to the first cord spool and a second suspension cord connected to the second cord spool;

a shade suspended from the first cord spool and the second cord spool;

a counter balance system positioned within the header and operably connected with the drive shaft, wherein the counter balance system provides a counter balance force to the drive shaft to counter the weight of the shade;

wherein the motorizable shade system is converted from a manual state to a motorized state by adding the motor assembly to the header system by inserting the motor assembly into the header from an open end along the preformed guide until a drive adapter of the motor assembly operatively connects with the drive shaft such that rotation of the drive adapter rotates the drive shaft.

9. The system of claim 8 wherein a motor of the motor assembly, the drive shaft, the first cord spool, the second cord pool and the counter balance system rotate around the same axis of rotation.

10. The system of claim 8 wherein the motor assembly includes a motor, a control board, and an encoder wherein the encoder tracks the position of the shade relative to the header system.

11. The system of claim 8 further including an operational cord connected with the shade.

12. The system of claim 8 further including an antenna for remote activation of the motor assembly wherein the antenna is wholly connected on or in the motor assembly.

13. The system of claim 8 further including a timer connected with said control board of the motor assembly.

14. A method for converting a manual shade to a motorized shade, the method comprising the steps of:

providing a manually operated shade comprising:

a header system including a header, the header having an inside and an outside and extending a length between open ends;

the header having an integral header attachment connection wherein the integral header attachment connection comprises a preformed guide on the inside of the header;

at least one cord spool connected with a drive shaft positioned within the header system, the at least one cord spool connected with at least one suspension cord;

a shade suspended from the at least one suspension cord;

a counter balance system positioned within the header system and connected with the drive shaft, wherein the counter balance system provides a counter balance force to the drive shaft to counter balance weight of the shade;

providing a motor assembly, comprising:

a motor, a control board, a drive adapter, an antenna, and a motor assembly attachment connection wherein the motor assembly attachment connection is conformed to engage the integral header attachment connection;

inserting the motor assembly into an open end of the header such that the motor assembly attachment connection engages the integral header attachment connection of the header;

sliding the motor assembly within the header along the integral header attachment connection until the drive adapter of the motor assembly operatively connects with the drive shaft such that rotation of the motor assembly rotates the drive adapter which rotates the drive shaft thereby the shade is operated by the motor.

15. The method of claim 14 further comprising the step of activating the motor of the motor assembly in response to input from a group of inputs consisting of: a predetermined amount of daylight, user generated remote signals, and a tug on the shade.

16. The method of claim 14 further including a timer connected with the motor assembly wherein the control board includes a time threshold for movement of the shade from an open position to a closed position.

17. The method of claim 14 further comprising the step of tracking the position of the shade relative to the header system using an encoder operatively connected with the motor and the control board.

* * * * *